US010328476B2

(12) United States Patent
Keeling

(10) Patent No.: US 10,328,476 B2
(45) Date of Patent: Jun. 25, 2019

(54) BENDING MACHINE

(71) Applicant: Mark Keeling, Clonakilty (IE)

(72) Inventor: Mark Keeling, Clonakilty (IE)

( * ) Notice: Subject to any disclaimer, the term of this patent is extended or adjusted under 35 U.S.C. 154(b) by 210 days.

(21) Appl. No.: 15/506,531

(22) PCT Filed: Aug. 27, 2015

(86) PCT No.: PCT/EP2015/069640
§ 371 (c)(1),
(2) Date: Feb. 24, 2017

(87) PCT Pub. No.: WO2016/030461
PCT Pub. Date: Mar. 3, 2016

(65) Prior Publication Data

US 2017/0232494 A1 Aug. 17, 2017

(30) Foreign Application Priority Data

Aug. 28, 2014 (EP) ..... 14182625

(51) Int. Cl.
*B21D 9/05* (2006.01)
*B21D 7/06* (2006.01)
*B21D 7/024* (2006.01)

(52) U.S. Cl.
CPC ..... *B21D 7/066* (2013.01); *B21D 7/024* (2013.01); *B21D 9/05* (2013.01)

(58) Field of Classification Search
CPC ..... B21D 7/066; B21D 7/024; B21D 9/05
USPC ..... 72/389.6
See application file for complete search history.

(56) References Cited

U.S. PATENT DOCUMENTS

| | | | | |
|---|---|---|---|---|
| 1,473,101 A | | 11/1923 | Hossfeld | |
| 2,892,479 A | | 6/1959 | Holsclaw | |
| 4,788,847 A | * | 12/1988 | Sterghos | B21D 7/06 72/212 |
| 4,870,849 A | | 10/1989 | Traub | |
| 5,598,736 A | | 2/1997 | Erskine | |

FOREIGN PATENT DOCUMENTS

| | | |
|---|---|---|
| CN | 202984375 U | 6/2013 |
| DE | 199 11 808 A1 | 8/2000 |
| EP | 2 380 674 A2 | 10/2011 |
| FR | 1 241 458 A | 9/1960 |
| GB | 468406 A | 7/1937 |
| GB | 566226 A | 12/1944 |

OTHER PUBLICATIONS

Internationalpreliminary Report on Patentability issued in PCT/EP2015/069640; dated Feb. 28, 2017.
International Search Report issued in PCT/EP2015/069640; dated Nov. 2, 2015.

* cited by examiner

*Primary Examiner* — David B Jones
(74) *Attorney, Agent, or Firm* — Studebaker & Brackett PC

(57) ABSTRACT

A bending machine has a main spindle which supports a die. There are two counter dies each mounted on a working arm which rotate about the main spindle. The working arms are driven by link arms which are acted on by a translational drive. There is versatile three-point bending caused by three die points, two on the working arms and one on the die support shaft. The working arm drive includes a translational component which extends through the die support shaft, and which is connected to the link arms. This achieves excellent symmetry and compactness.

20 Claims, 23 Drawing Sheets

BENDING MACHINE

FIELD OF THE INVENTION

The invention relates to a bending machine for bending metal workpieces.

PRIOR ART DISCUSSION

U.S. Pat. No. 4,870,849 describes a clamp die assembly for tube bending. GB566226 describes a machine with two dies operating in tandem. GB468406 describes a machine having formers mounted on a turret. U.S. Pat. No. 1,473,101 describes an iron bender with bars having holes to receive pins. CN202984375 describes a pipe bending machine with a moving seat and a fixed die.

Also, it is known to provide a bending machine which has a die on a vertical post and a counter die on a lever arm. The lever arm is rotated to move the counter die with respect to the die, with sufficient force to bend the workpiece.

The invention is directed towards providing a bending machine which is simpler and/or more versatile, and/or more accurate.

SUMMARY OF THE INVENTION

According to the invention, there is provided a bending machine comprising:

a die support shaft, at least two working arms:

mounted to rotate about the die support shaft, and arranged to each support a counter die and to rotate about the die support shaft to move the counter dies to bend a work-piece in conjunction with a die on the die support shaft, and a drive for the working arms, said drive comprising a translational drive driving link arms pivotally connected to the working arms.

In one embodiment, the translational drive comprises a ram.

In one embodiment, the translational drive acts on a pivot joint or joints interconnecting the link arms.

In one embodiment, the translational drive acts on a longitudinal axis extending through a longitudinal axis of the die support shaft.

In one embodiment, the die support shaft has a through-hole for the translational drive, and the die support shaft may be of integral construction.

In one embodiment, the working arms have a plurality of counter die support fixtures. In one embodiment, said fixtures include holes or sockets.

In one embodiment, the machine further comprises a counter die support arranged for mounting on a working arm and supporting a die. This provides for indirectly supporting a counter die on a working arm, giving the possibility of further adjustment of the counter die position with respect to the working arm. In one embodiment, said support is adapted to allow adjustment of position of a counter die with respect to the working arm. In one embodiment, the adjustment is infinite. In one embodiment, the supports are arranged to support counter dies asymmetrically. In one embodiment, the adjustment is translational.

In one embodiment, the machine comprises a die drive mechanism arranged to directly rotate a bearing for a die or a die. This provides for roller bending, with traversal of the work-piece through the machine. In one embodiment, the die drive mechanism is dedicated to a die bearing or die. In one embodiment, the die drive mechanism has a gear transmission.

In one embodiment, the die drive mechanism has a manual or automatic actuator.

In one embodiment, the die drive mechanism comprises a feature for engaging a working arm at a location spaced apart from the bearing, to prevent rotation of the die drive mechanism. In one embodiment, said feature is spaced apart by a distance corresponding to separation of two engagement features of a working arm. The feature may be a pin for engaging a hole in the working arm.

In one embodiment, the machine comprises a plurality of die drive mechanisms, and said mechanisms are arranged to operate in synchronism for roller bending of a work-piece. In one embodiment, said die drive mechanisms are interlinked. In one embodiment, said die drive mechanisms have inter-engaging gears.

In one embodiment, the die support shaft is rotatable on a fixed machine base for adjustment of orientation of the machine.

In one embodiment, the machine comprises a lock for locking a working arm, causing at least one joint to be static and other joints to be movable in a plane normal to the die support shaft axis.

In one embodiment, the machine further comprises means for locking the translational drive to prevent it from rotating with respect to a machine base. In one embodiment, a pivot joint of a working arm is hollow and is arranged to support a die, and a rotational drive extends through said joints to apply rotational drive to a die.

In one embodiment, the joint is between a link arm and a working arm.

In one embodiment, the base includes a hydraulic drive arranged to pump oil through conduits in the die support shaft to the working arm drive.

In one embodiment, the machine further comprises a die support comprising a plate with a slot to guide translational movement of a die.

DETAILED DESCRIPTION OF THE INVENTION

Brief Description of the Drawings

The invention will be more clearly understood from the following description of some embodiments thereof, given by way of example only with reference to the accompanying drawings in which:—

DESCRIPTION OF THE EMBODIMENTS

Figure 1:
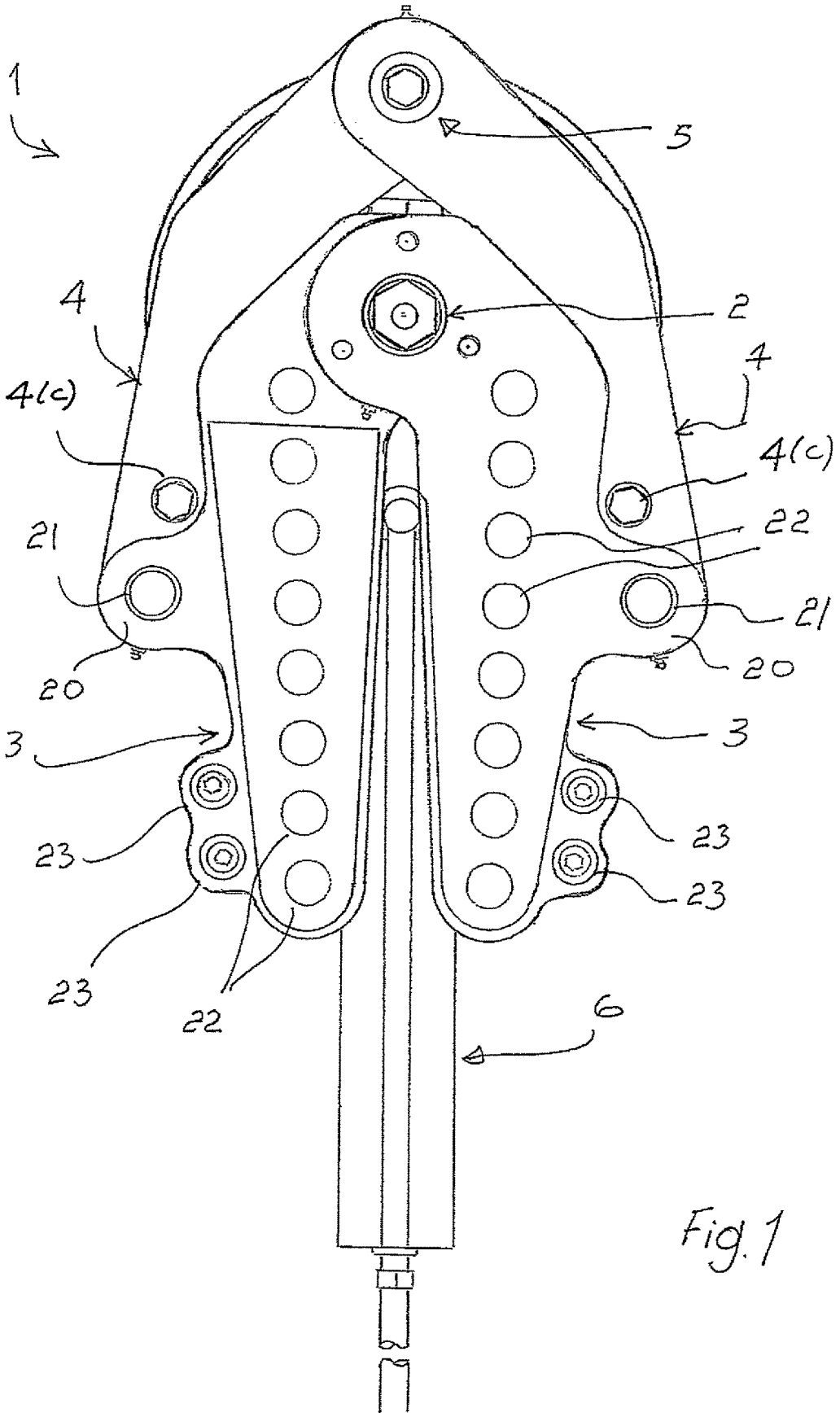
FIGS. 1 and 2 are plan views of a bending machine of the invention, showing different positions of die-support working arms.

Referring to FIGS. 1 to 4 a bending machine 1 is for three-point bending in a versatile manner. The machine 1 comprises a main spindle 2 which extends vertically. The spindle 2 is non-rotating during a bending operation. However, it may be rotated about a base 40 for desired orientation of the machine main working parts.

Two working arms 3 are pivotally mounted on the main spindle 2 under action of link arms 4. The link arms 4 are connected to each other at their outer ends by a pivot joint 5 and are each connected at their inner ends to a working arm 3 by a pivot joint 21 on a lug 20. The working arms 3 each have a series of holes 22 for receiving counter dies.

Each working arm 3 also has posts 23 which interconnect two arm plates 3(*a*) and 3(*b*), joining the plates so that they form a unit. This spreads the bearing load in the vertical direction on the main spindle 2.

The link arms 4 each comprise two arm plates 4(*a*) and 4(*b*) joined by pillars 4(*c*) and spacers 4(*d*).

To ensure accuracy, the spindle 2 is mounted on the base 40 by connection by a bronze bearing in a protractor ring 30. The ring 30 is in turn fixed to the remainder of the base 40.

Figure 2:
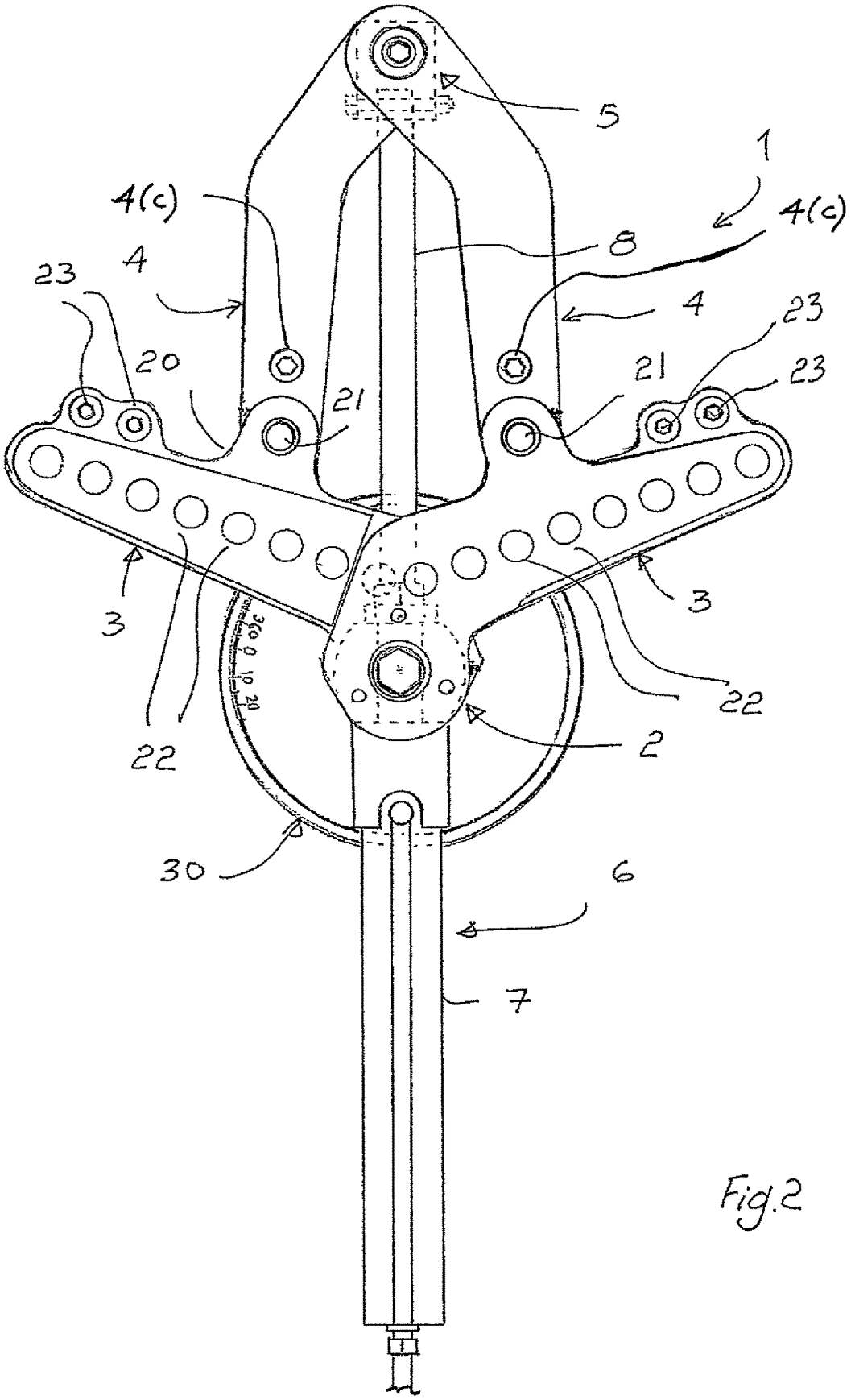

All of the machine 1 above the disc or ring 30 is rotatable by rotation of the spindle 2 in the bearing in the ring 30. A particular angular position for the upper part of the machine with respect to the base may be locked by one or more of three clamps 31. One clamp 31 locks the ram 6 to prevent it rotating, but leaves everything else free to rotate, as shown in FIGS. 1 and 2. The other two clamps 31 lock a working arm 3 to the ring 30. These are only used for particular modes of operation where it is desired to prevent one of the working arms from rotating, as described in more detail below.

A working arm drive is in this embodiment a ram 6 having a cylinder 7 which passes through the spindle 2 and a piston 8. This provides a translational, linear, drive along a horizontal longitudinal axis which passes orthogonally through the vertical axis of the main spindle 2.

There is a piston follower 35, a piston follower clamp 36, and a valve/switch 37. The purpose of the piston follower 35 is to support the clamp 36 so that it can be locked to any desired position along its length. The clamp 36 in turn acts as a stop which contacts a push-to-open valve 37 which is mounted to the piston follower guide which in turn is mounted to the hydraulic cylinder 7. As the piston 8 extends the follower 35 follows it, moving the clamp 36 to the left as viewed in FIG. 3. The clamp 36 will contact the valve 37 spool and activates the valve, oil is diverted back to the hydraulic tank, in turn stopping the linear motion of the ram, thus enabling bends to be reproduced accurately.

Figure 3:
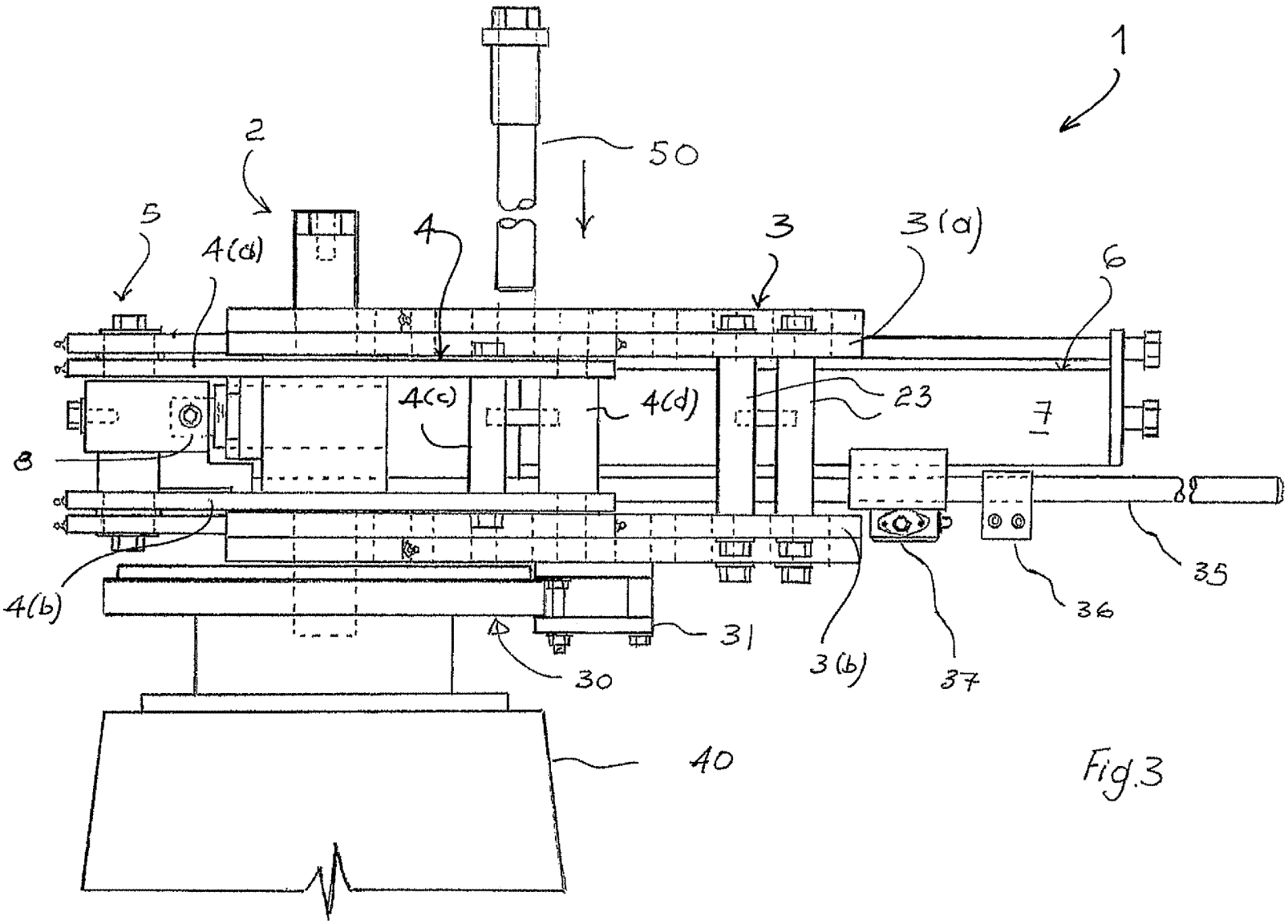
FIG. 3 is a side view of the machine.

FIG. 3 shows a pin 50 for insertion in one of the holes 22 of a working arm 3 to support a counter die, as described in more detail below.

Figure 4C:
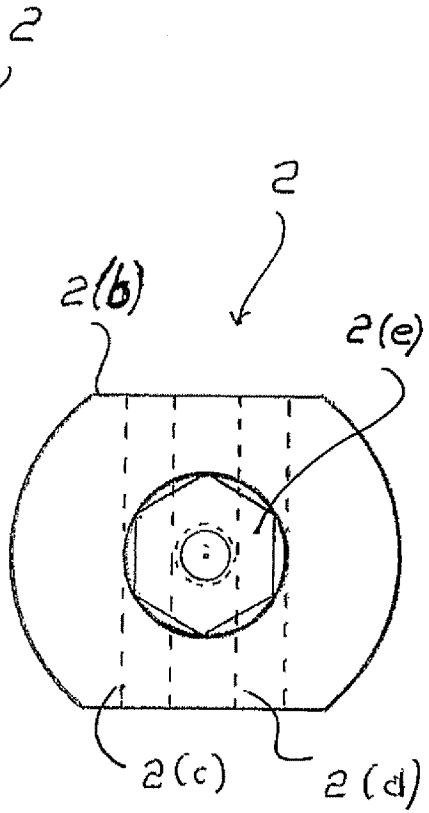
FIGS. 4(*a*), (*b*), and (*c*) are front, side, and plan views respectively of a main spindle.
Figure 4B:
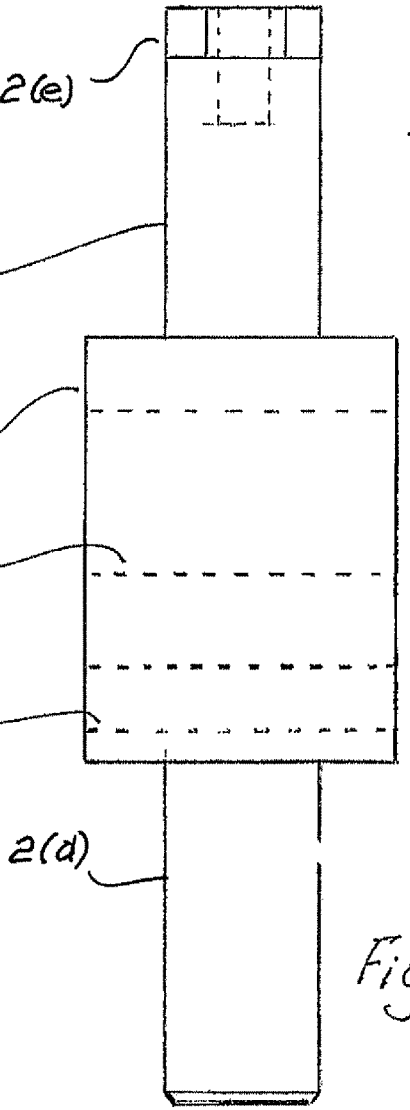
Figure 4A:
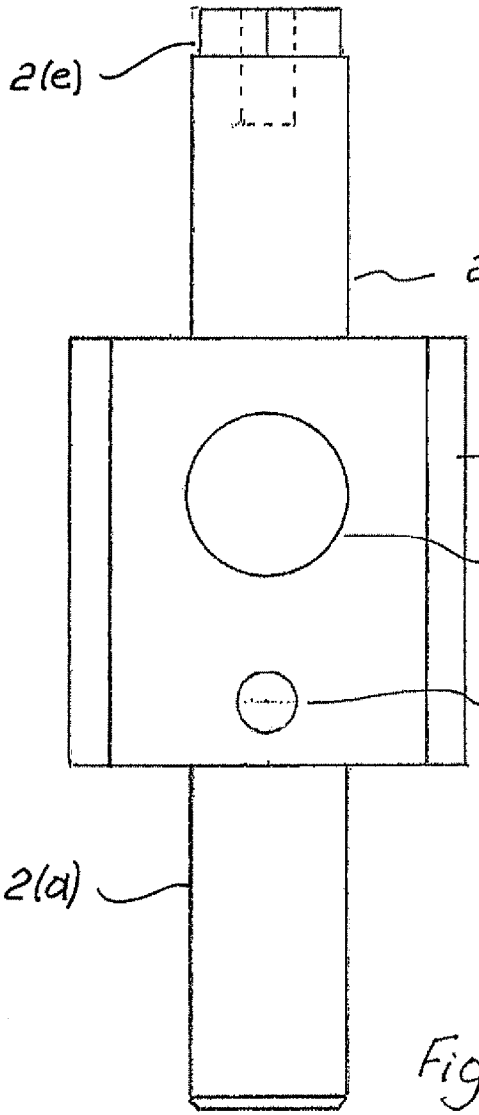

As shown most clearly in FIG. 4, the main spindle 2 is machined from a single piece of steel. It has a vertical shaft 2(*a*), and an integral fixture 2(*b*) through which there is a hole 2(*c*) for the cylinder 7 and a hole 2(*d*) for the piston follower. This arrangement allows the main spindle 2 perform the roles of:

- a common pivot joint for the working arms 3 (which support the counter dies),
- a support for the die,
- a guide and an attachment point for the drive ram 6 for moving the link arms 4.

There is a hexagonal head 2(*e*) on top of the spindle 2 for preventing rotation of a die mounted on the spindle 2.

The spindle 2 has the holes 2(*c*) and 2(*d*) perpendicular to its axis, through one of which the hydraulic cylinder passes and is attached by means of a nut, and the other one through which the piston follower 35 passes. It is also the vertical axis about which the machine above the base 40/30 rotates, independently of its base 40 and the degree plate (protractor ring) 30. The spindle 2 also has a threaded hole through its axis, through which a bolt and washer assembly can secure tooling. As the hydraulic cylinder 7 passes through the hole 2(*c*) in the main spindle 2, the hex orientation for die support cannot change relative to the cylinder.

There are three ring clamps 31, one of which is attached to the cylinder of the hydraulic ram, the other two being attached to each working arms 3. Only one clamp 31 can be activated at any one time.

Figure 5:
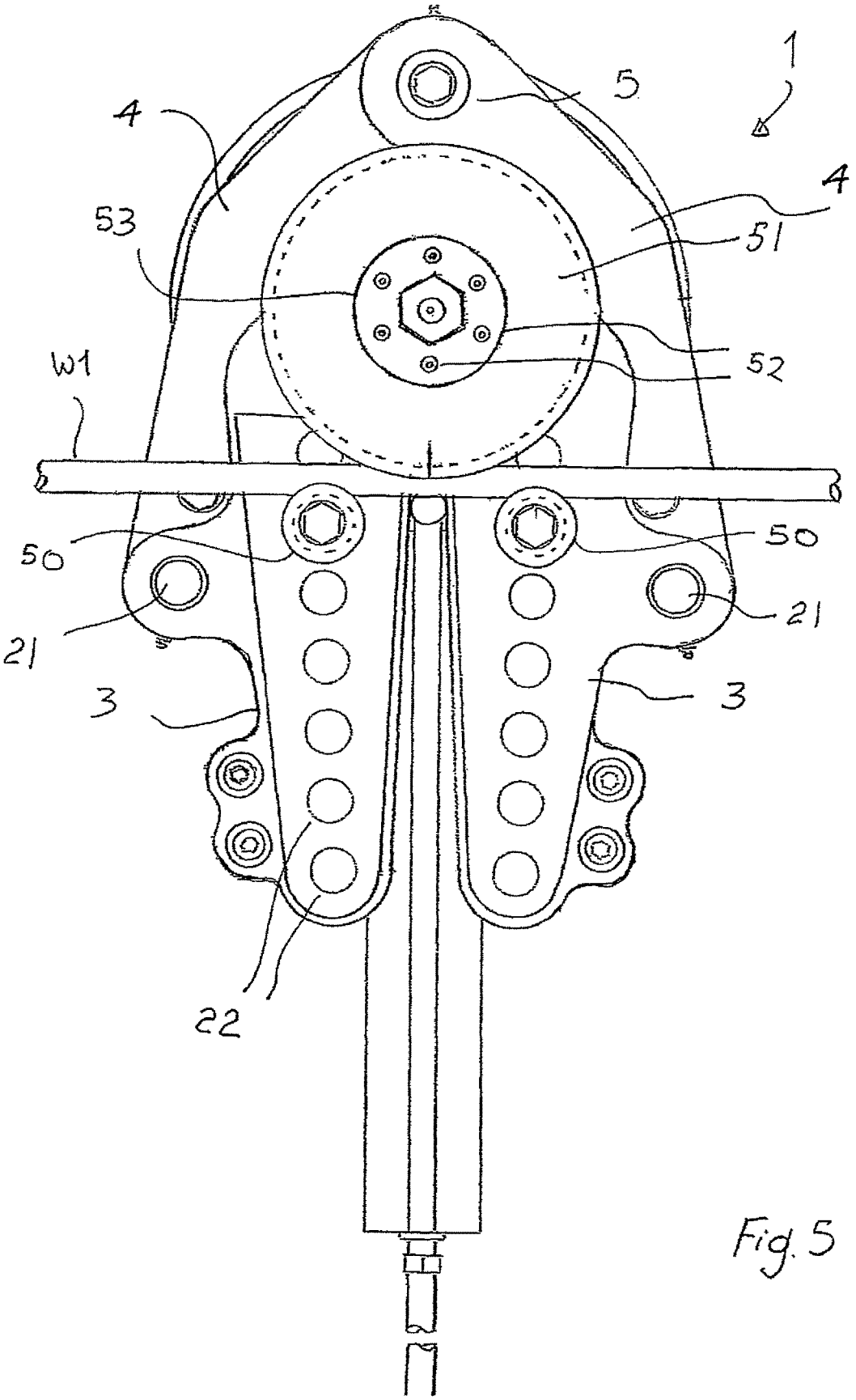
FIGS. 5 and 6 are plan and side views of the machine ready to start bending a tube.
Figure 6:
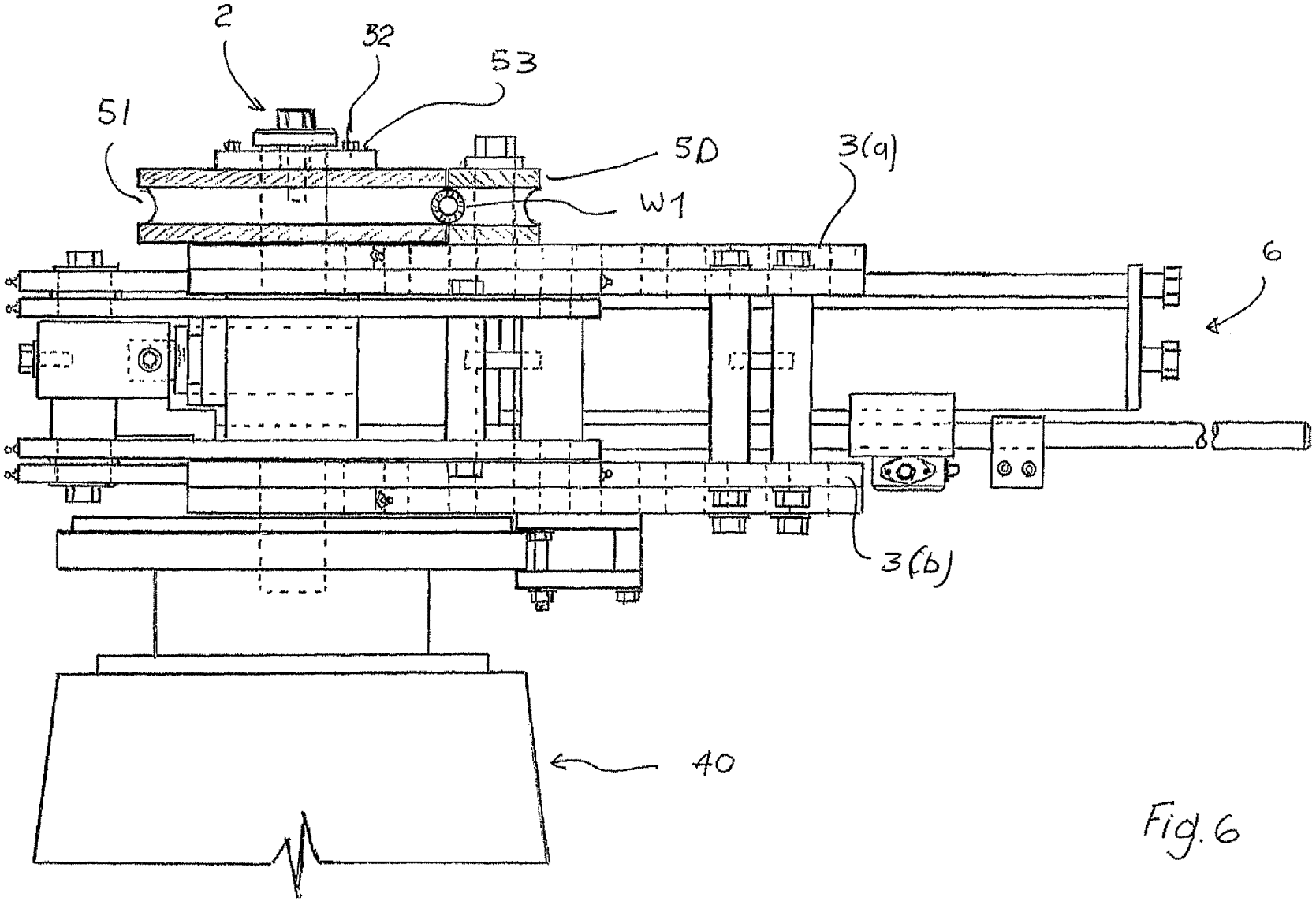

Referring to FIGS. 5 and 6 there are two pin counter dies 50 pegged into holes 22 of the working arms 3 and a die 51 on the main shaft 2. There is a hexagonal index plate 53 over the die 51, to prevent the die from rotating about the main spindle (using six bolts 52).

Figure 7:
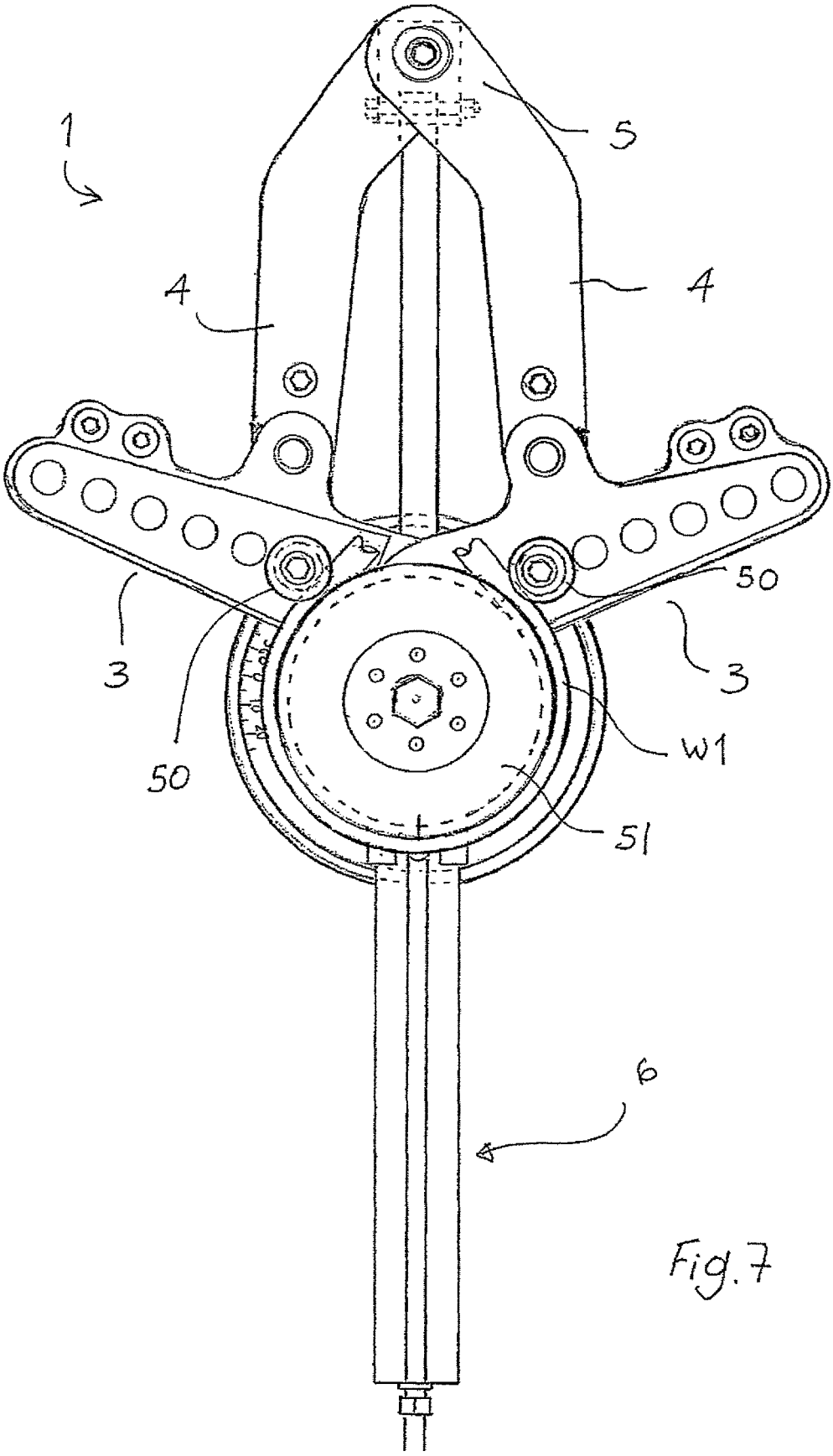
FIG. 7 is a plan view after it has bent.

In one example of operation a straight tube work-piece W1 is placed horizontally between the counter dies 50 on one side and the die 51 on the other. Operation of the hydraulic ram 6 to extend the piston 8 pulls, via the link arms 4, the working arms 3 so that the tube W1 is formed around the die 51, as shown in FIG. 7.

This is merely one example of a very wide variety of ways in which the machine 1 can be used to form workpieces. Any of many different types of dies and counter dies may be mounted, the positions of the counter dies may be selected by choice of hole 22 to use or it may be infinitely adjustable by using a counter die support on at least one of the working arms 3.

Extension of the piston 8 causes symmetrical movement of the arms 3 and 4 about the longitudinal axis of the ram 6. Example positions are shown in FIG. 1 (piston 8 retracted), FIG. 2 (piston 8 fully extended), FIG. 13 (only partially extended).

The machine may be used even if one of the working arms 3 is locked by for example a clamp 31 to the base 30/40. In this case, there are two fixed pivot joints, the main shaft 2 and one of the joints 21. The other joint 21 and the link arm joint 5 move in the horizontal plane, and the piston 8 drives the joint 5. The ram 6 and the opposing working arm 3 rotate about the axis of the main spindle 2, albeit at different speeds i.e. the ram 6 moves at half of the degrees of rotation of the opposing working ram.

The machine could also be used, for example, if the ram 6 is locked by a clamp 31 to the degree ring 30. In this case there is a fixed pivot joint 2. Both of the joints 21 and 5 move in the horizontal plane. Both of the working arms 3 rotate about the axis of the main spindle 2 with equal degrees of rotation.

Figure 8:
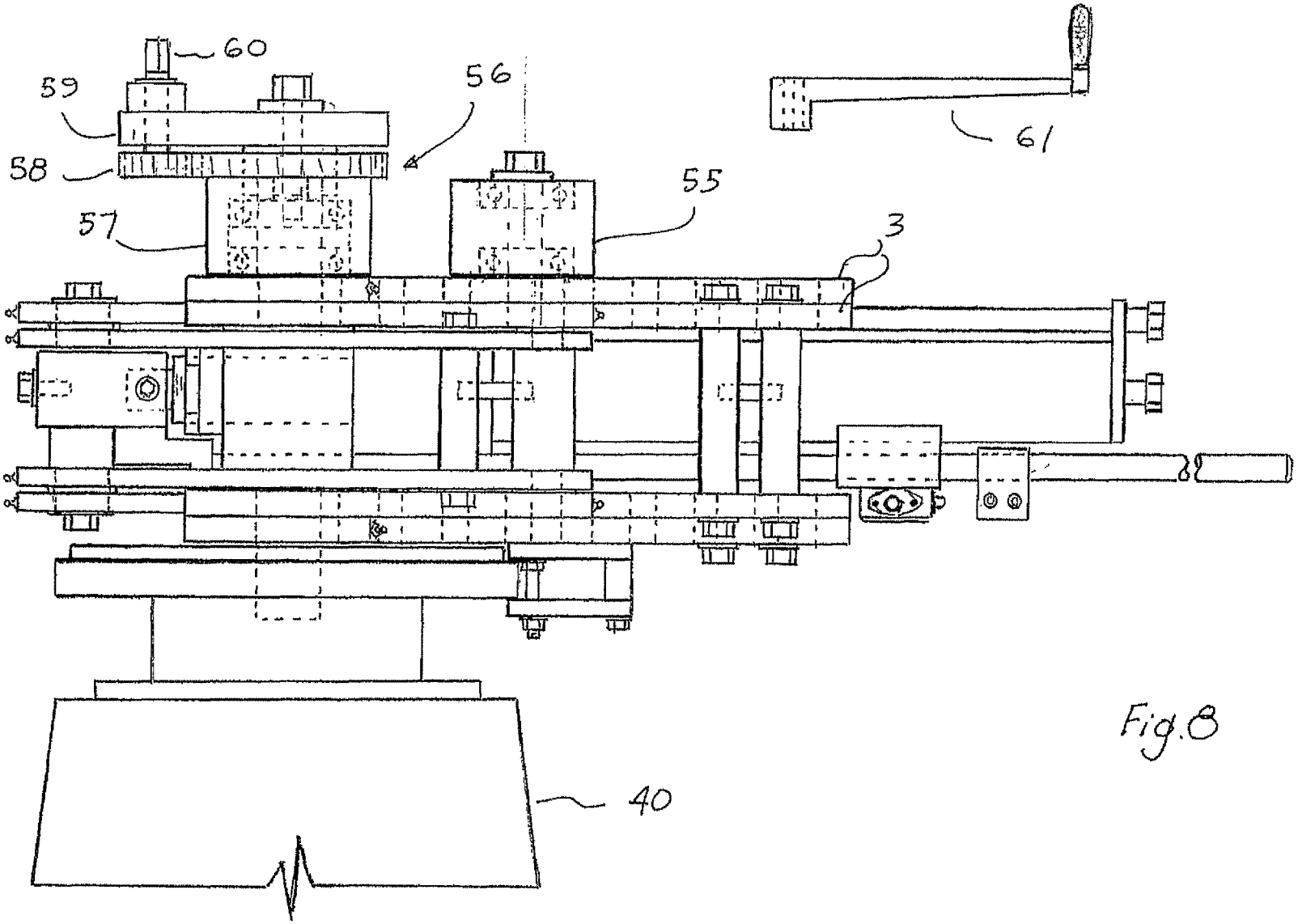
FIGS. 8 and 9 are side views showing mounting of a roller die assembly.
Figure 9:
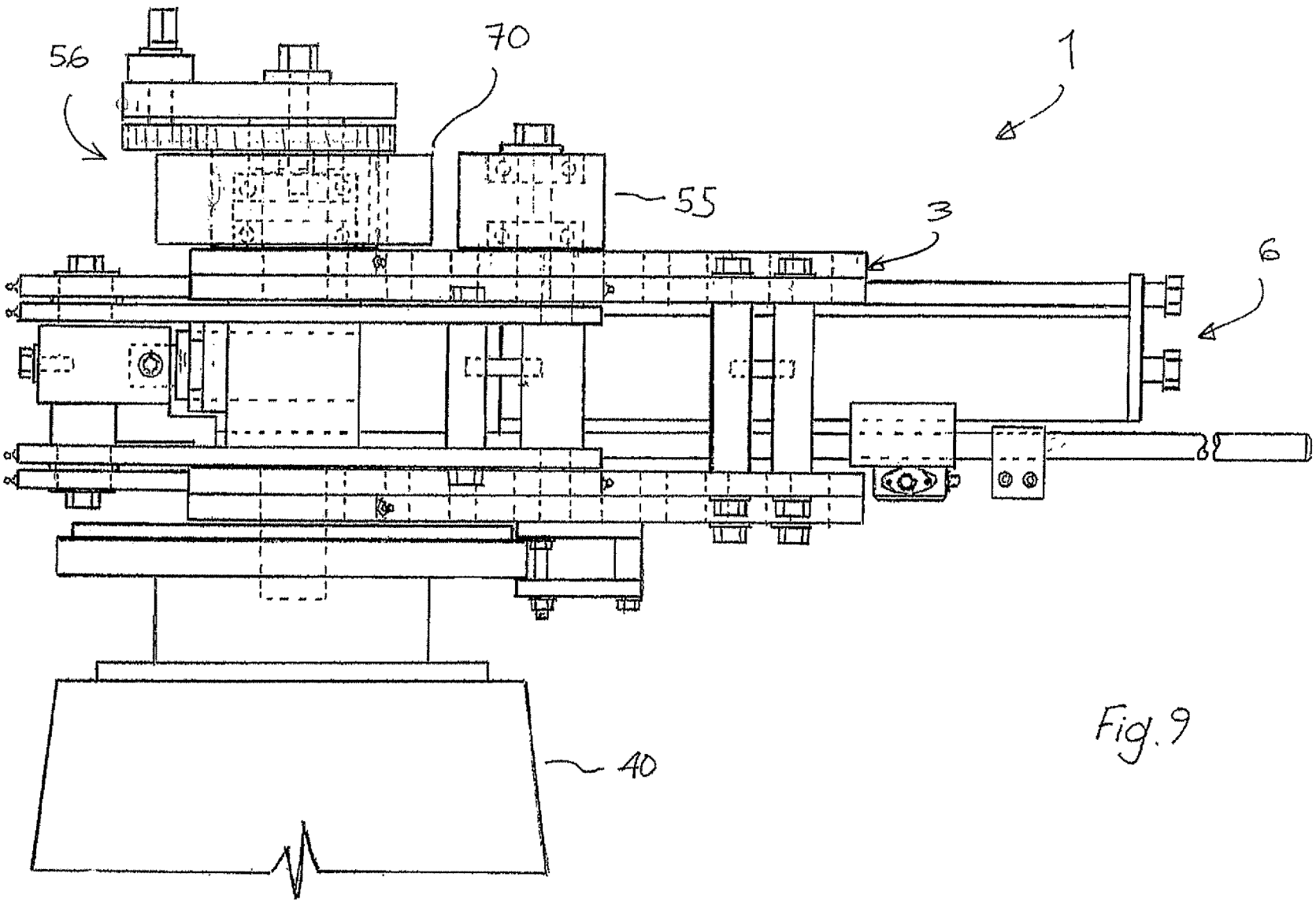

Referring to FIGS. 8 and 9 two ball bearing counter dies 55 are mounted on the working arms, and a roller die assembly 56 is mounted on the main spindle 2. The roller die assembly 56 has a bearing 57 and a gear unit 58 and a top plate 59 through which extends an actuator shaft 60 which is rotated by a handle 61. In this particular set-up one of the three clamps 31 may be locked to the degree plate 30.

Figure 10:
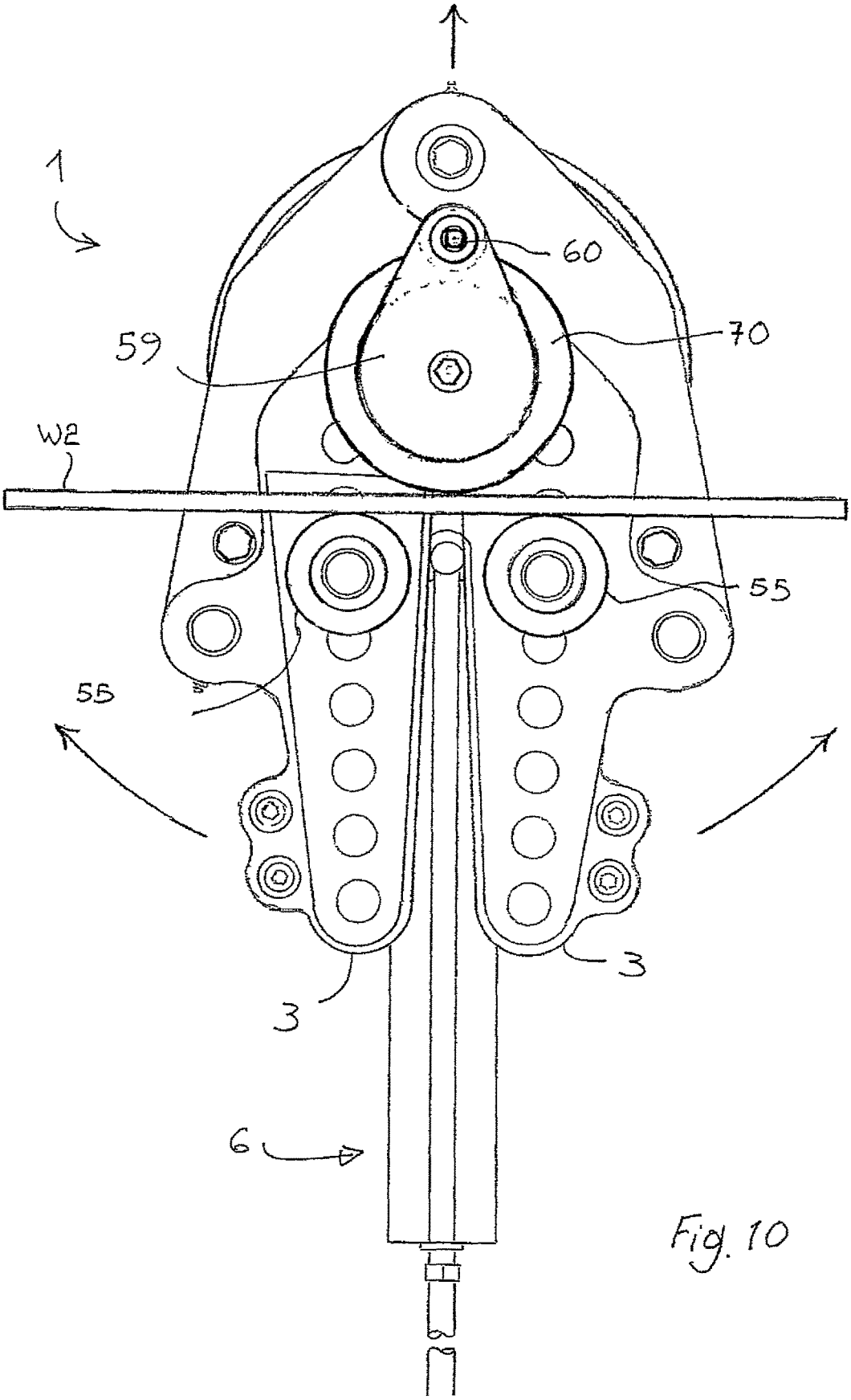
FIG. 10 shows the machine ready for use with this roller die assembly.

Referring to FIG. 10, when a work-piece W2 is inserted between the two counter dies 55 and a die 70, a small extension of the piston 8 moves the counter dies 55 to a point where the desired bend is achieved. Rotation of the handle 61 causes the roller die 70, keyed to the die bearing 57, to rotate to move the work-piece through the machine as it is formed into the desired radius of curvature. In this mechanism, the actuator 60 connects to a gear which drives a larger gear which is fixed to the bearing 57. With this set-up, infinitely variable radius of curvature can be achieved in the work-piece.

Figure 11:
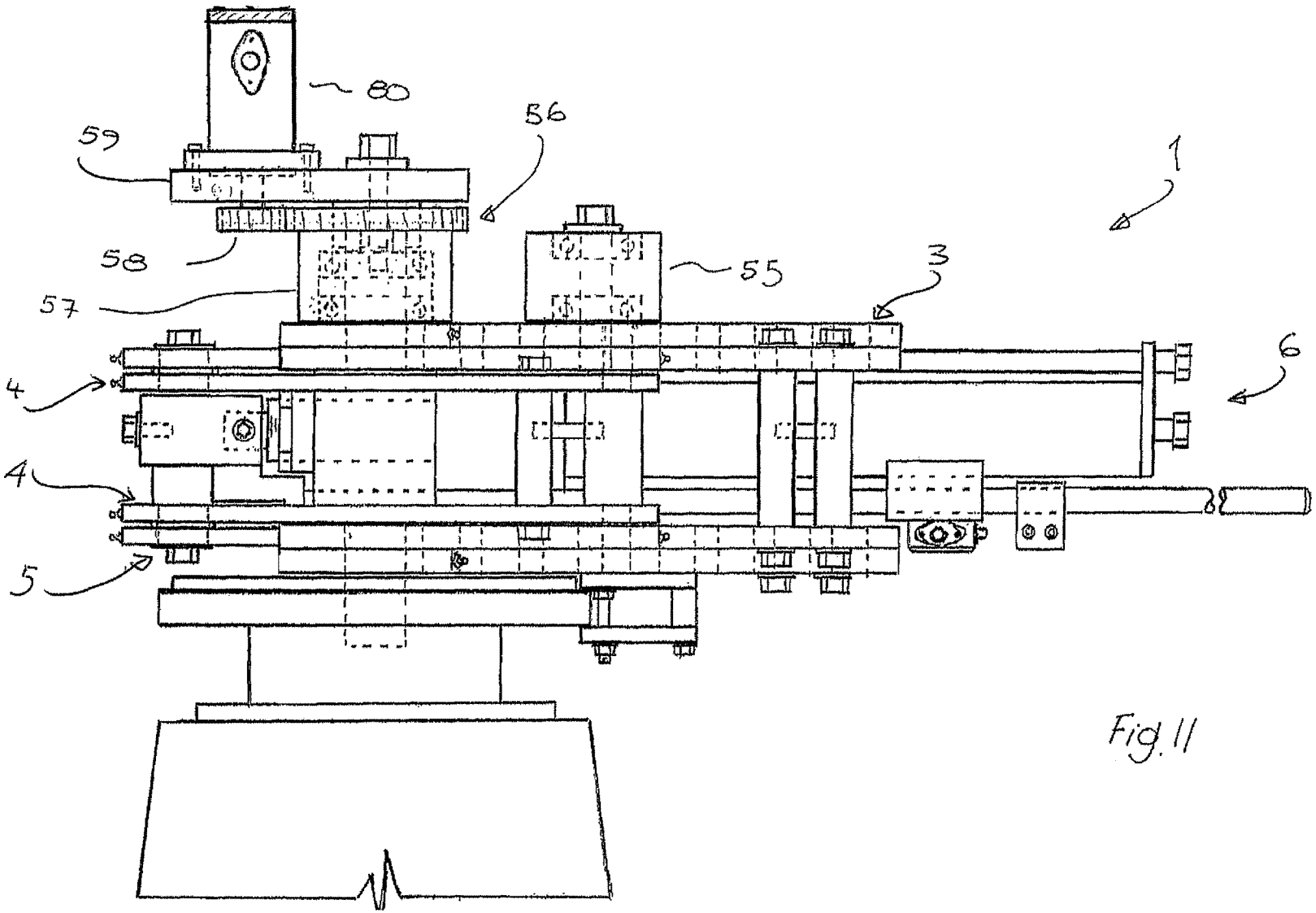
FIG. 11 shows addition of a motorized die actuator.

FIG. 11 shows a variation in which an hydraulic motor 80 causes the die 70 (not shown) to rotate (via the gear train 58). This is of course convenient and provides a uniform speed of operation.

Figure 12:
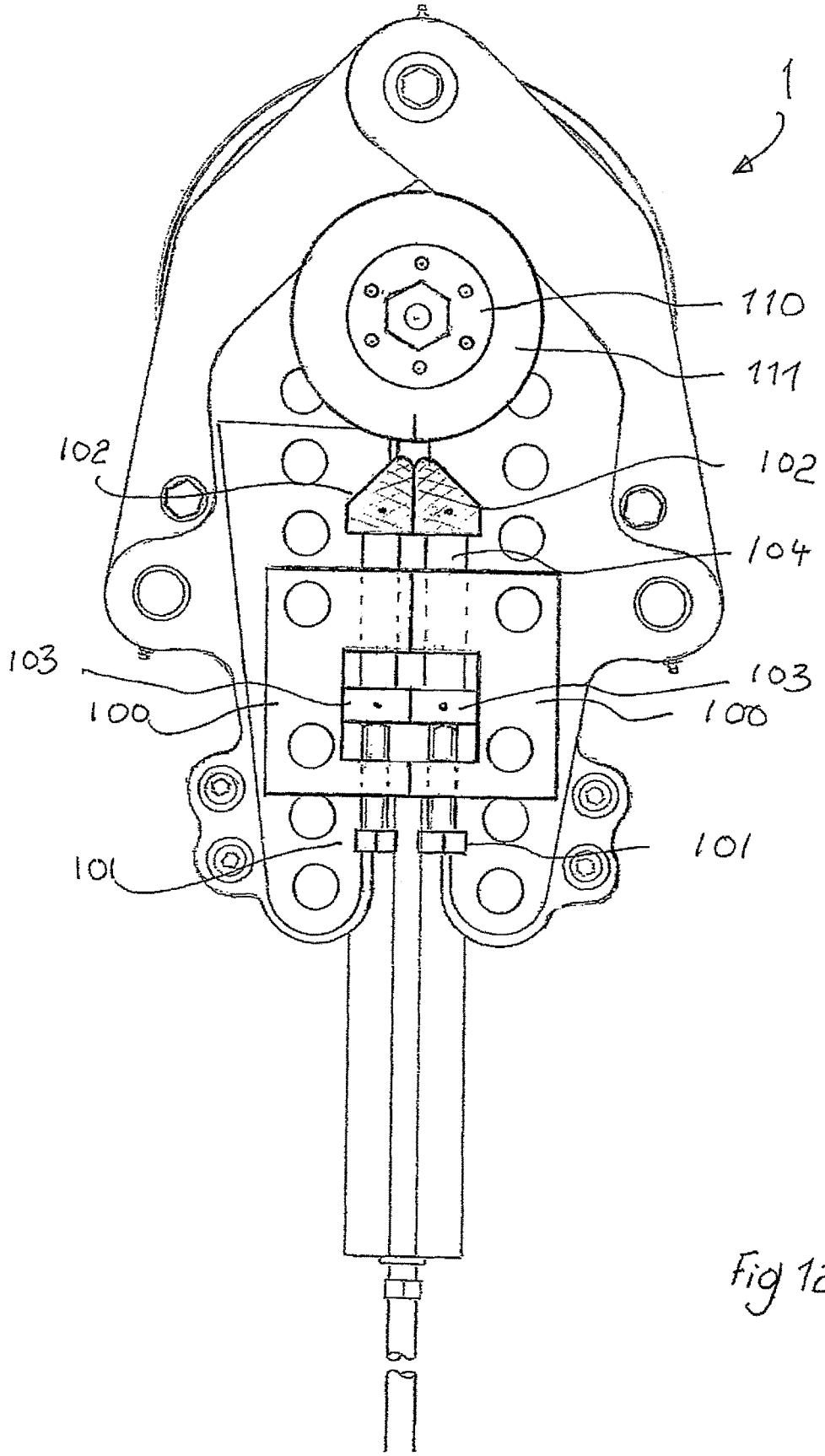
FIGS. 12 and 13 are plan views showing use of a pair of adjustable counter die supports.
Figure 13:
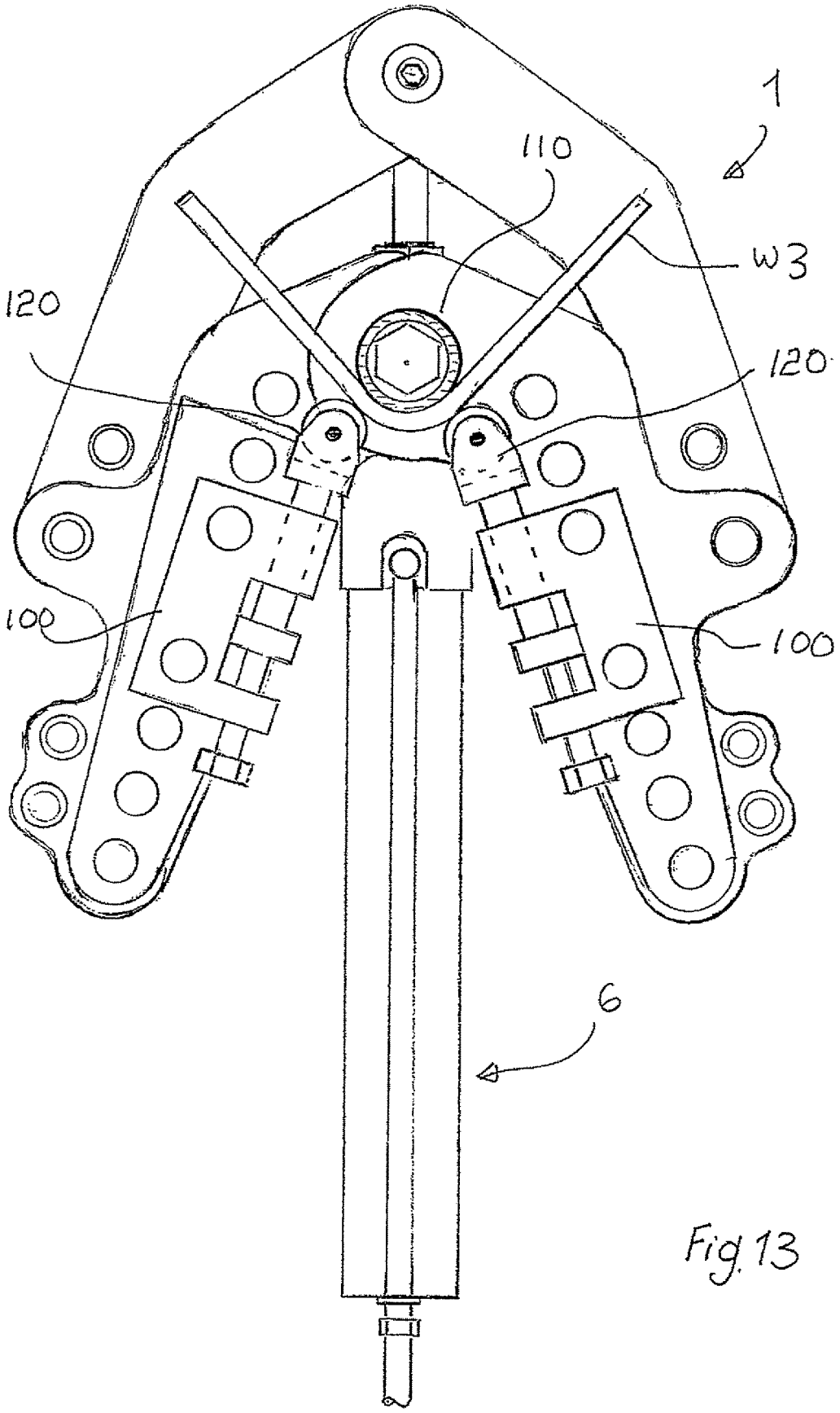

As shown in FIGS. 12 and 13 a counter die support 100 may be mounted on each working arm 3 at any combination of the holes 22. This supports a counter die 102 at a position with an infinite adjustment in a direction to or from the main spindle 2 axis. Adjustment screws 101 are used for this infinite adjustment, as they cause translational movement of a bronze glider plate 103 attached to a hardened round steel pin 104 at the outer end of which there is a counter die 102. The pin 104 is inserted into the plate 103 and retained there by a pin.

A die 110 comprises a round die 111 with a disc having a hexagonal hole in it. These two are attached by six bolts, stopping rotation on the spindle 2.

The infinitely adjustable counter die supports 100 can act asymmetrically. For example there could be fixed anvil as one counter die and a roller counter die as another, in different positions.

The ram 6 can be locked to the ring 30 and as a result of this, the degrees read off the degree plate are half of the value indicated as both arms 3 are travelling in opposing directions. If one arm 3 is locked to the degree plate, then both the ram 6 and the opposing working arm 3 rotate about the main spindle 2, albeit at different speeds i.e. the ram is moving at half the degrees as the working arm.

This arrangement allows infinite adjustment to suit the workpiece dimensions and the desired bending angles, as shown in FIG. 13 (which shows alternative counter dies 120).

Figure 14:
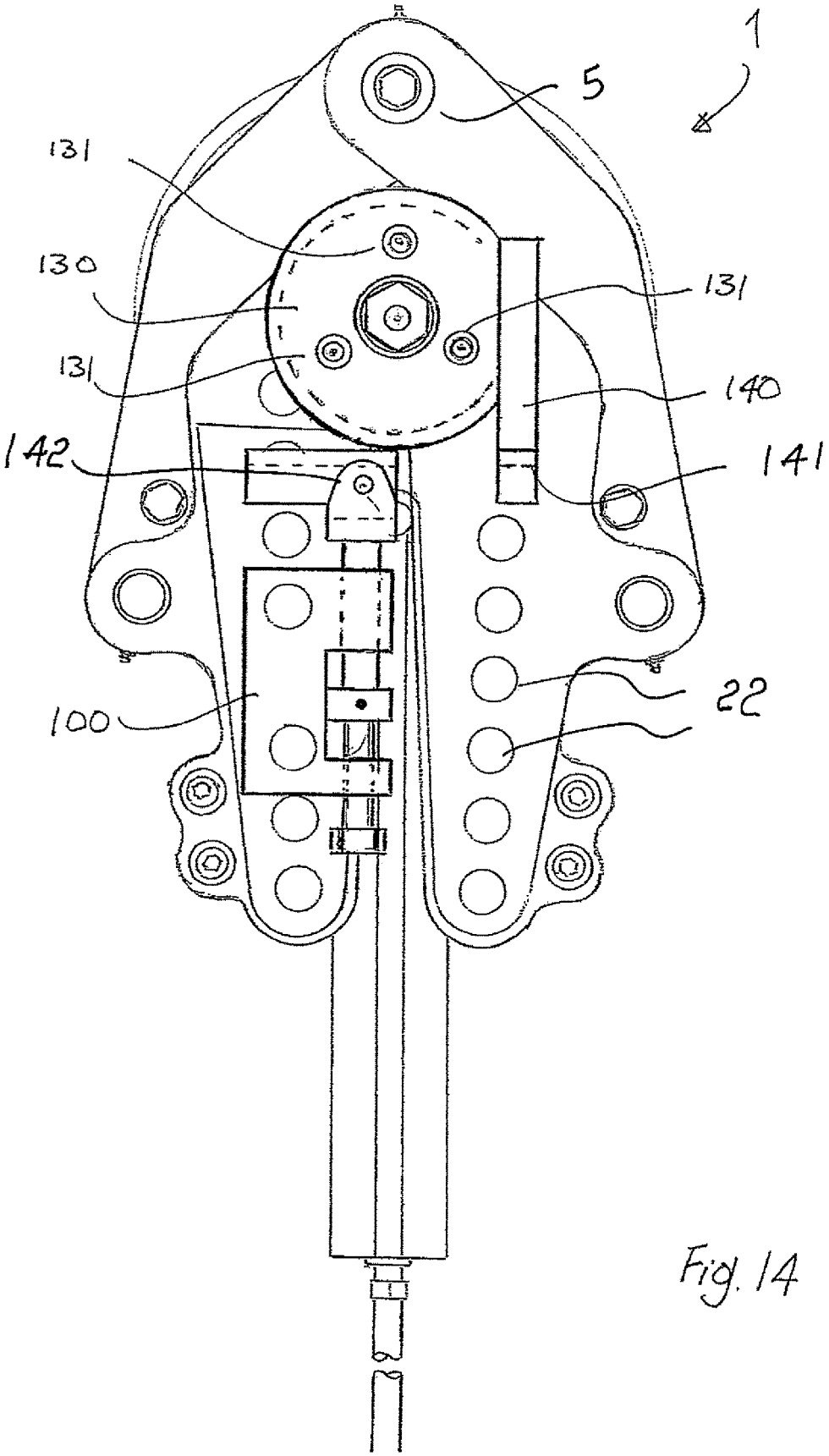
FIG. 14 shows use of a hook for guiding a work-piece.

FIG. 14 shows the support 100 being mounted on one working arm 3, and a die 130 which is free to rotate about the main spindle 2. There is a material hook 140 for gripping and anchoring to provide one point of the three-point bending. The main die 130 is attached to the material hook 140 and acts as one piece. That assembly is bolted to the working arm 3 by means of bolts 131, and is free of the hex on the spindle 2 and as such is free to rotate about the main spindle 2 in conjunction with working arm 3.

The hook 140 acts as one point in a three-point bending setup. The counter die tip 142 is another point in this system, and the main die 130 is the last. As the machine 1 cycles, the hook 140 (with an internal opening 141) retains the material which is drawn through the counter die, held by the adjustable counter die support. This process is referred to as "rotary draw bending".

Figure 15:
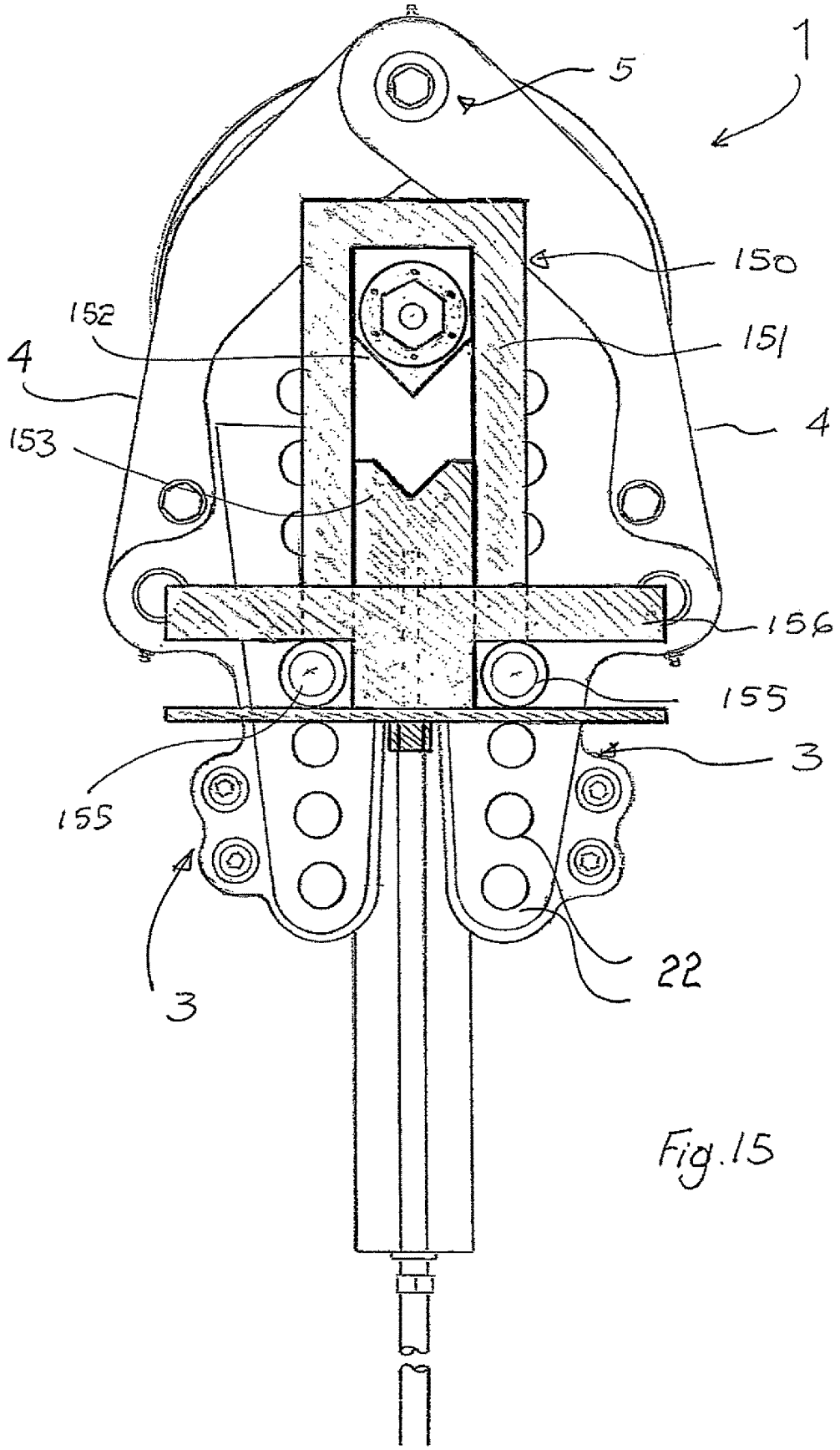
FIG. 15 shows a tooting arrangement for a V-bend.
Figure 16:
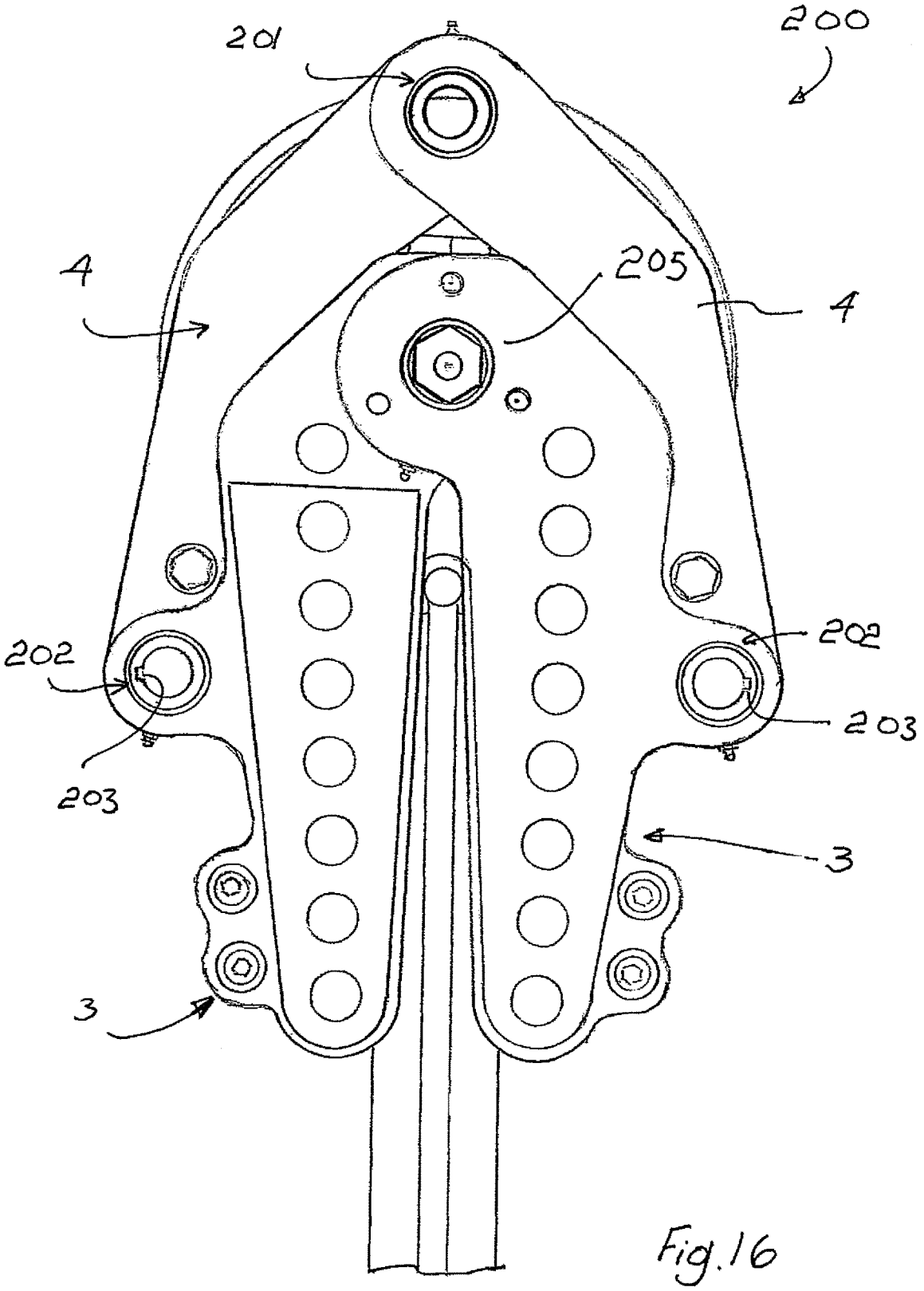
FIG. 16 shows an alternative bending machine of the invention.

FIG. 15 shows a die set 150 for solid cross-sectional bar bending. A male V-shaped die 152 is mounted on the main shaft, while a female V-shaped counter die 153 slides in a frame 151 upon rotation of the working arms 3. As the arms 3 rotate pins 155 push against a base 156 forcing it to move translationally to slide the counter die 153 within the frame 151.

These are but some examples of use of the machine 1 for a very wide range of bending operations because the machine 1 is a three point bending platform, the main spindle 2 of which is an axis about which the working arms 3 rotate.

The working arms 3 act in pairs and by having a number of holes 22 can receive pins, which can be placed in any one of eight holes, acting as two of the points in the three point bending function.

Accuracy of location of the counter dies is achieved because they are on the arms 3 rotating about the spindle 2 and there is further rotation about the common joint 5, and the arms are driven by a common drive 6.

When the machine 1 is activated, the linear motion of the hydraulic piston 8 imparts its motion to the piston follower 35 and also acts on both pairs of link arms 4 simultaneously, which in turn act on both pairs of working arms 3, rotating them about the axis of the main spindle 2. The linkage assembly thus converts linear motion into rotary motion. Any material trapped between the counter dies on the arms 3 and the main spindle 2 die is subjected to a bending force. Force can be applied both on the push and pull strokes of the ram 6.

The machine 1 allows inter alia the following functions to be carried out with the appropriate tooling:

- rotary draw bending, to 220°,
- three point bending i.e. manufacture of U bolts, pipe bending up to 220° in both cases,
- V-block bending of a bar, square or round or any other solid cross-section.

The machine provides a bending platform which enables use of specialised, customised tooling, or standard tooling for e.g. section rolling, V block, pipe bending tooling etc. It allows such use in a very efficient and simple manner, eliminating the need to have individual machines to perform each individual task, and avoiding complicated set up procedures often associated with multifunction machines while at the same time avoiding the pin and ratchet system sometimes associated with single hydraulic cylinder machines. The machine 1 has a small footprint which has the ability to take the place of a minimum of three machines, namely section rolls, pipe bender, horizontal press.

The main spindle 2 plays a very important role in operation of the machine. It is the coaxial point about which both working arms 3 rotate, providing equal degrees about the axis of the machine in opposing directions, the mechanical function of which lends itself suitably to bending material equal degrees about a centre line. It also serves as the attachment point for the hydraulic cylinder as well as being the anchor point for the main bending dies. Its hexagonal cross section, when required, provides a rotational lock for the main bending dies, while also providing the axis about which the machine itself rotates, independently of its degree plate and base. This feature facilitates long lengths of material to be bent and maneuvered within a confined space while eliminating material whip as the machine can rotate to align itself with the material being bent.

The machine also provides ease of use. When single bends are required, and the machine is set up appropriately, degrees can be read directly off the degree plate 30. For multiple bends, once the piston 8 stroke length has been established and the clamp set accordingly, multiple bends of the same angle can be achieved using one control lever.

The small footprint saves valuable workspace, especially in its start position as it folds back upon itself.

The ability to cater for multiple tooling is very advantageous. It provides an unobstructed and level working surface on which a multitude of tooling may be mounted, allowing multiple bending functions to be carried out. These include:

- 180° or more bends in flat bar, bent the hard way, used for example in traditional farmyard gates.
- Custom die bending i.e. the manufacture of bow shackles etc.
- Section rolling: solid and hollow cross sections.
- Freeform bending: shaping scrolls, elliptical forms etc.
- Straightening of bent stock and forged material.
- V Block bending.
- Sharp 90 degree bends etc.
- Manufacture of u bolts, pipes etc. up to 220 degrees.
- Bending of concrete reinforcing bars, electrical conduits, or copper pipes etc.

The aspect of the machine whereby all major components perform multiple roles, makes for a very efficient machine both in its function and use, given the relatively few moving parts it requires i.e. minimum wear and long life expectancy All greasepoints are easily accessible and all wear components can be replaced (bronze bushes)

Also the machine can be manufactured in any size, and so is scalable.

Referring to FIGS. 16 to 20 an alternative machine, 200, is illustrated. Like parts are given the same reference numerals. The machine 20 has a hollow link arm pivot joint 201, and hollow joints 202 for connection of the link arms 4 to the working arms 3. The joints 202 have internal keyways 203. There is a main spindle 205.

A base 210 of the machine 200 has a twin-port hydraulic rotary union distributer 215 fed by an electric motor 211 and hydraulic pump 212 assembly. There is an auxiliary valve 216. The distributer 215 feeds the spool valve 230. The auxiliary valve 216 feeds, via flexible hoses (not shown), two hydraulic motors 220, in turn driving the hollowed keyed shafts 203. These drive the dies 261 in the use shown in FIGS. 17 and 18.

Figure 17:
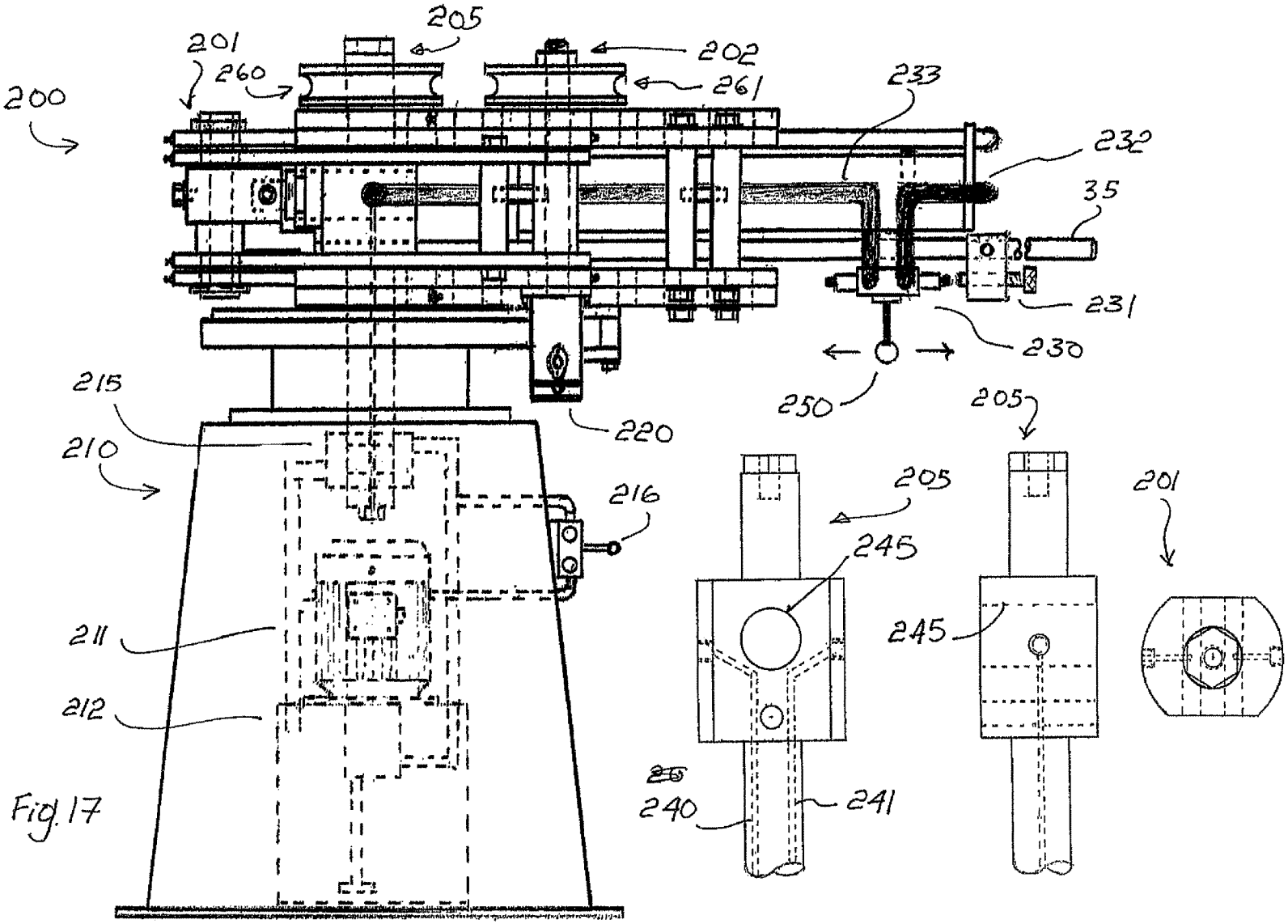
FIGS. 17 and 18 show the machine of FIG. 16 in use set up for section rolling of a tube.
Figure 18:
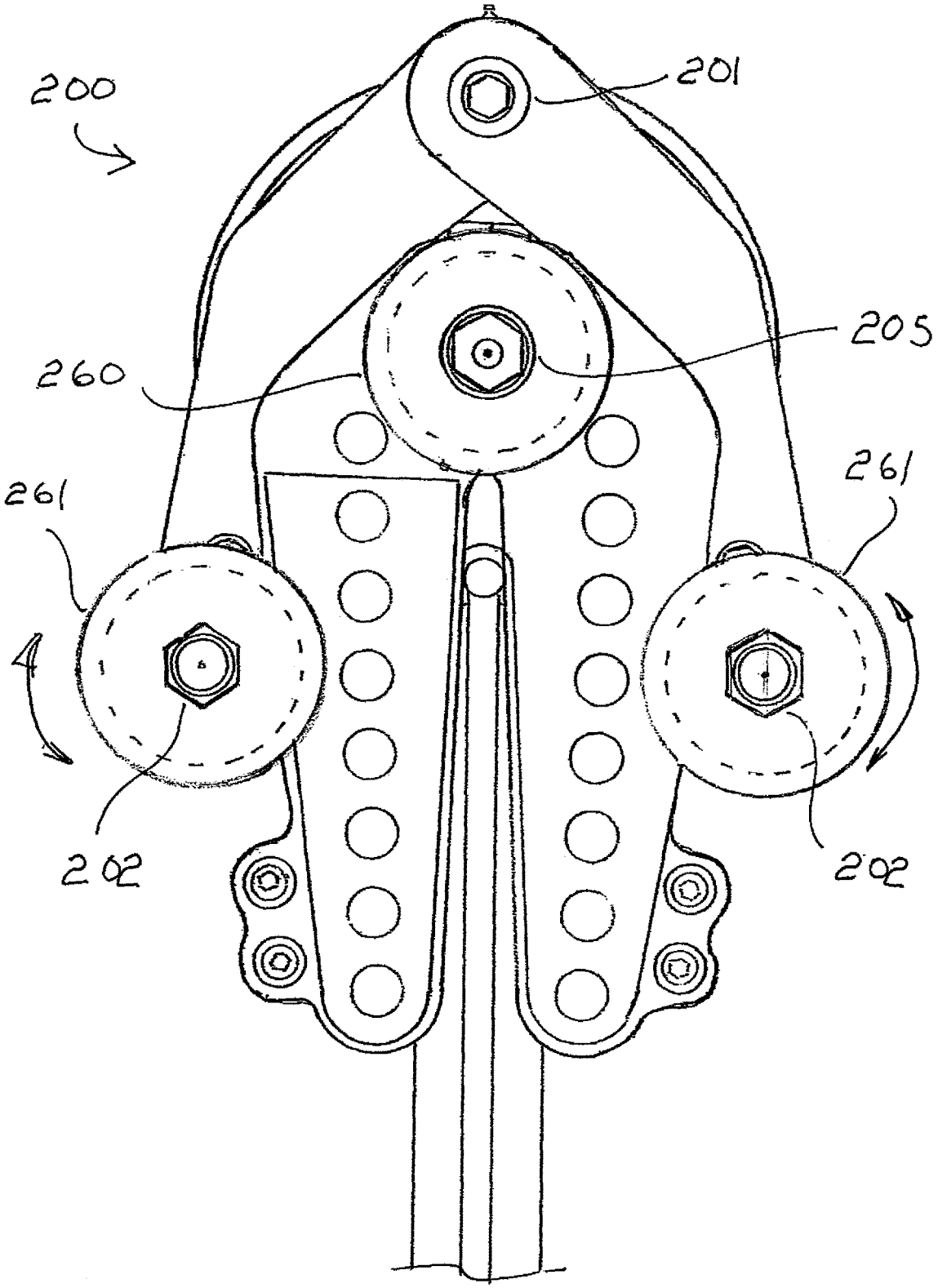
Figure 19:
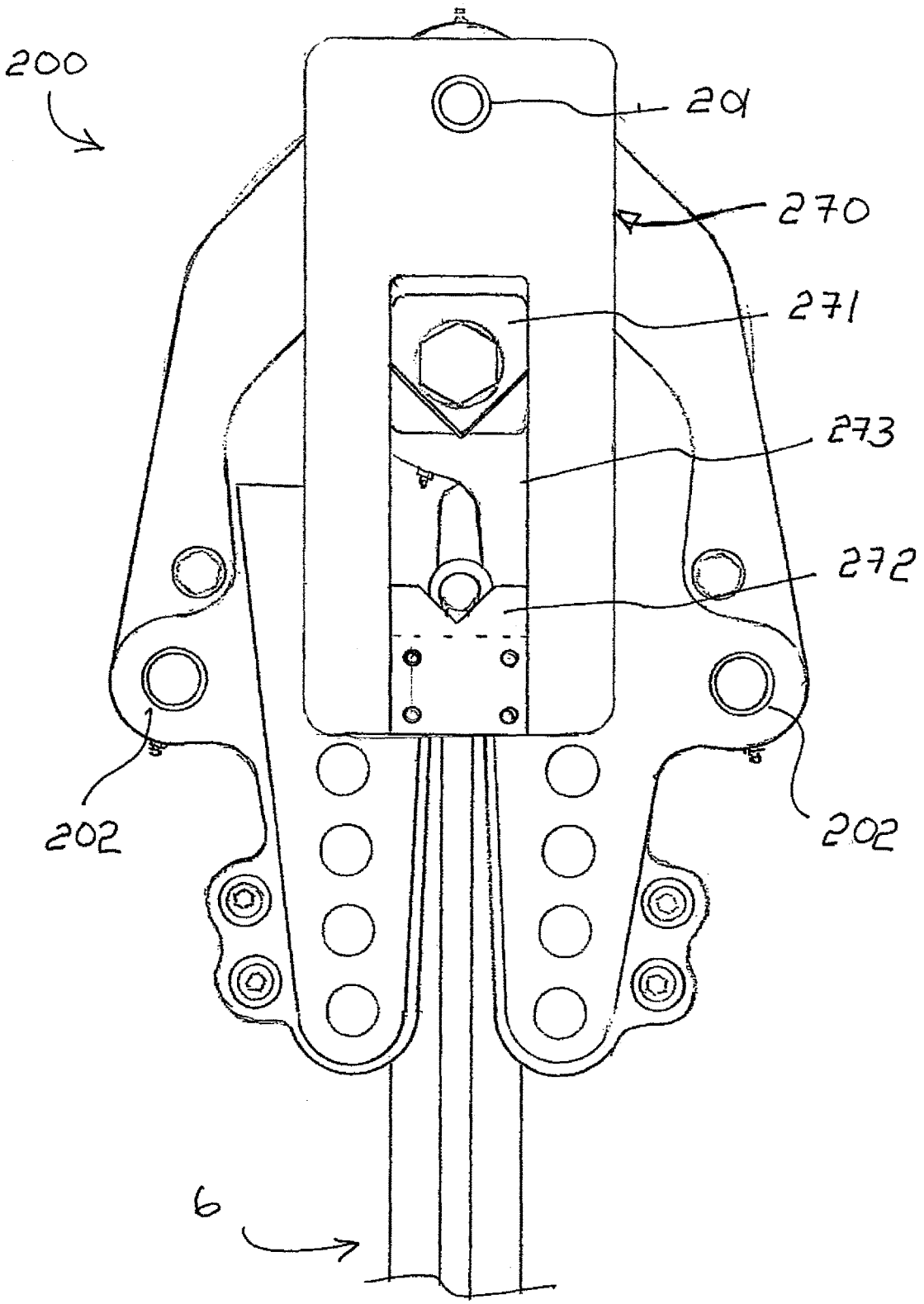
FIGS. 19 and 20 show the machine of FIG. 16 in plan and elevation set up for sharp bending up to 90°.
Figure 20:
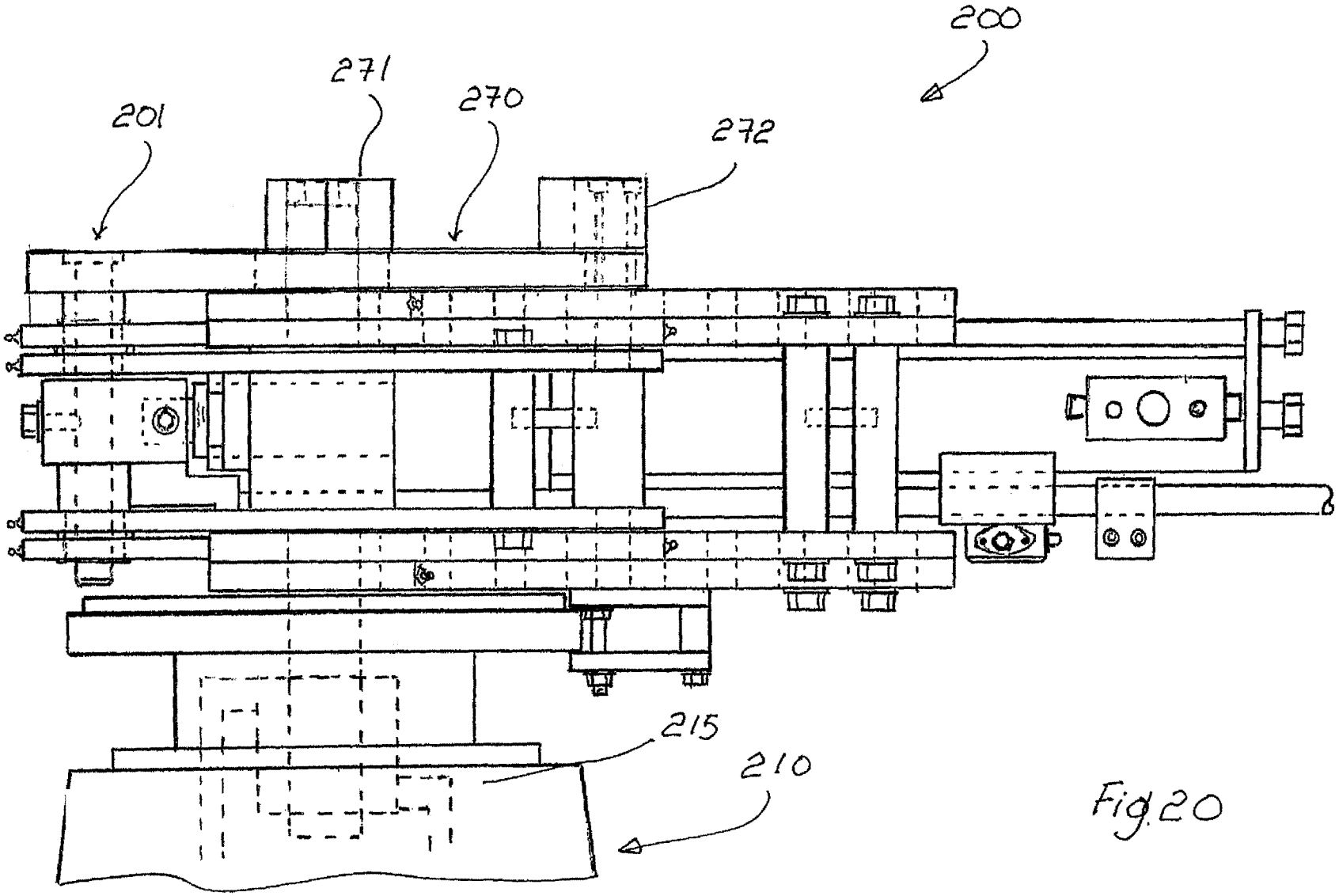

The machine 200 also has a spool valve 230 and there is an adjustable stop 231 on the piston follower 35. Hydraulic lines 232 run from the spool valve 230 (FIG. 17).

The main spindle 205 has a through-hole 245 for the ram 6, and pressure and return hydraulic conduits 240 and 241 which feed hydraulic oil to the ram 6 and potentially other parts such as motors 220. This reduces the number of flexible holes needed.

The spool valve 230 has a handle 250.

In operation, when the clamp 231 is attached to the piston follower 35 and the handle 250 is moved to the left, bend, position the end of the spool is forced to the rear of the machine. As the machine cycles the piston follower 35 clamp 231 moves towards the spool valve 230 until the end of the fine adjustment stop makes contact with the end of the spool. This forces the spool back to the neutral position. This achieves an infinitely variable fixed point used for producing multiple bends of the same degree. This depends on where the clamp 231 is set on the piston follower 35, and on where the fine adjustment is set.

In one example (FIGS. 17 and 18), a die 260 is free to rotate on roller bearings. Dies 261 are mounted on the joints 202. Rotational power is supplied to the dies 261 from the hydraulic motors 220, each attached to the working arms 3 which in turn are fed via flexible hoses from the valve 216 (hoses not shown). This example use allows for section rolling of pipe but with alternative dies it could be any section such as square or rectangular.

In another example (FIGS. 19 and 20) of use a sliding plate 270 is pivotally connected to the joint 201. However its movement is restricted to translational only, (sliding), movement by a fixed guide tool 271 on the spindle 205 extending through a rectangular aperture 273 in the plate 270. There is also a V-block moving tool 272 extending through the aperture 273. This is fixed to the sliding plate 270. This achieves a bending force between the dies 271 and 272 when the machine cycles.

Figure 21:
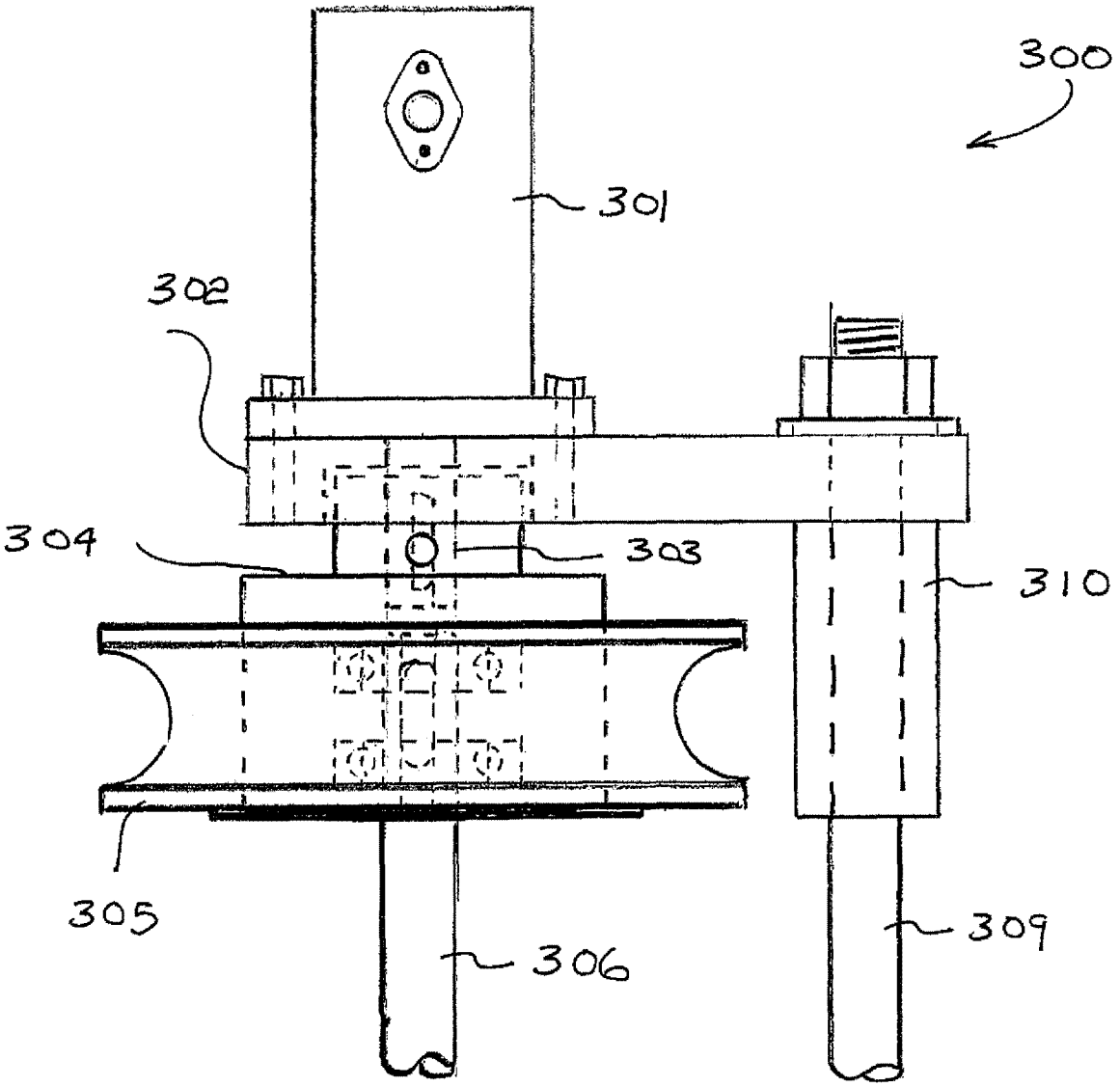
FIG. 21 shows a die assembly with a built-in drive.

Referring to FIG. 21 a roller die assembly 300 comprises an hydraulic motor 301 mounted on a plate 302 and having an output shaft 303 driving a bearing 304 (shown supporting a die 305). The bearing has a pin 306 for engaging a hole 22 of a working arm 3. The plate extends laterally and at its other end it supports a pin 309 on a spacer 310 arranged for engagement in another hole 22 of the same working arm 3. The die assembly provides its own independent drive and the pin 309 engagement in the hole 22 prevents it from rotating, so all of the motor's drive is applied to the bearing 304 and hence the die 305.

The die assembly 300 is particularly simple because it does not have a gear mechanism. The required speeds and torques may be applied by control of the hydraulic motor 301.

It will be appreciated that if both of the working arms support a "self-drive" die assembly 300 and the main spindle supports a self-drive die assembly such as the assembly 56 then all three dies may be driven. This allows very effective and fast roller bending.

Figure 22:
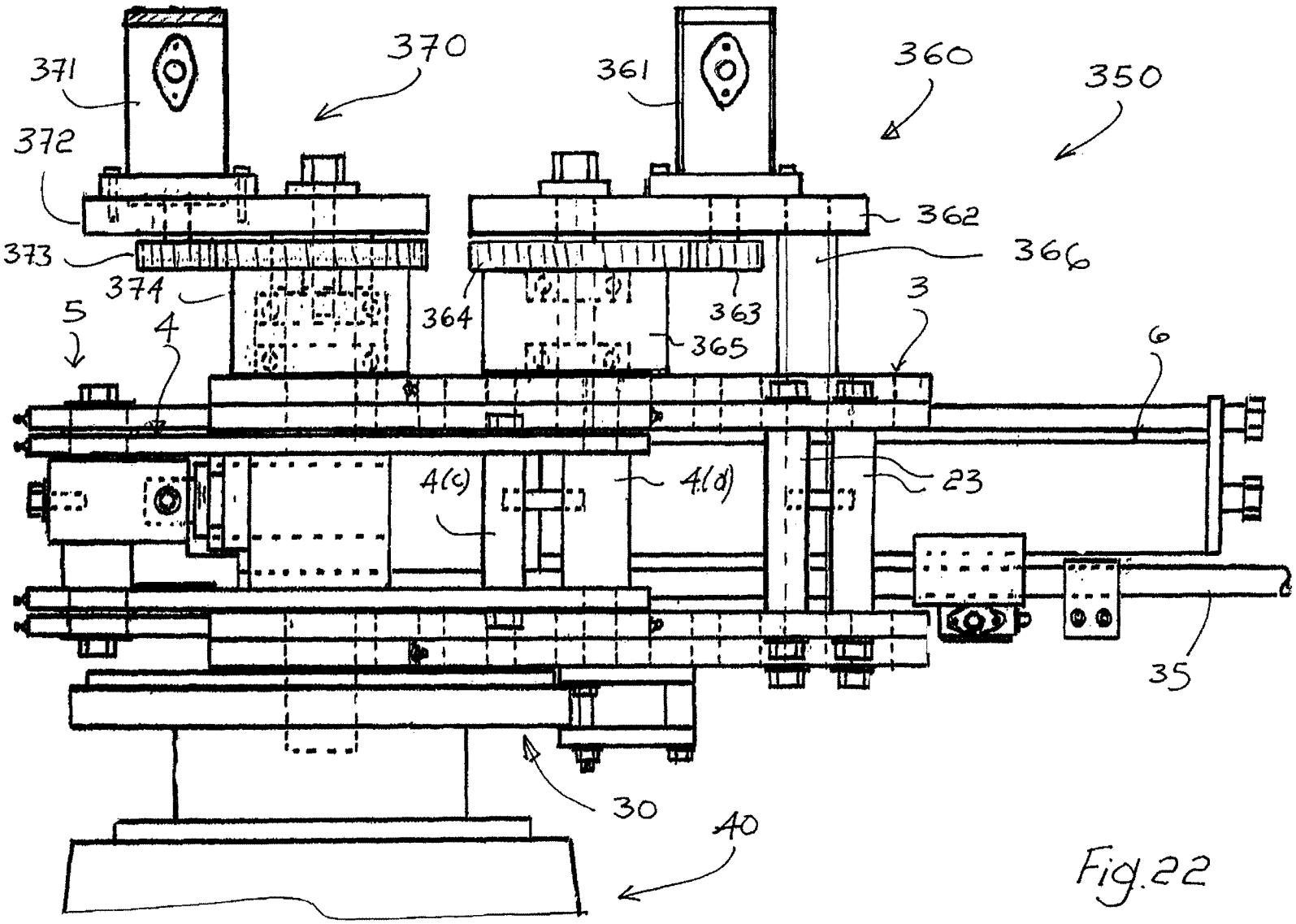
FIG. 22 shows a bending machine incorporating three dies with built-in drives, in this case incorporating gears.

Referring to FIG. 22 a machine has many parts like the machines described above, and like parts are indicated by the same reference numerals. There is a self-drive die assembly 360 on each of the working arms 3 and such a die assembly on the main spindle 2. Each assembly 360 has a motor 361 on a plate 362 and an output shaft gear 363 drives a larger gear 364, in turn driving a bearing 365 for a die. There is a pin 366 to prevent rotation of the overall assembly.

The assembly 370 comprises a motor 371 on a plate 372 driving a gear 373, in turn driving a larger gear on a bearing 374.

Figure 23:
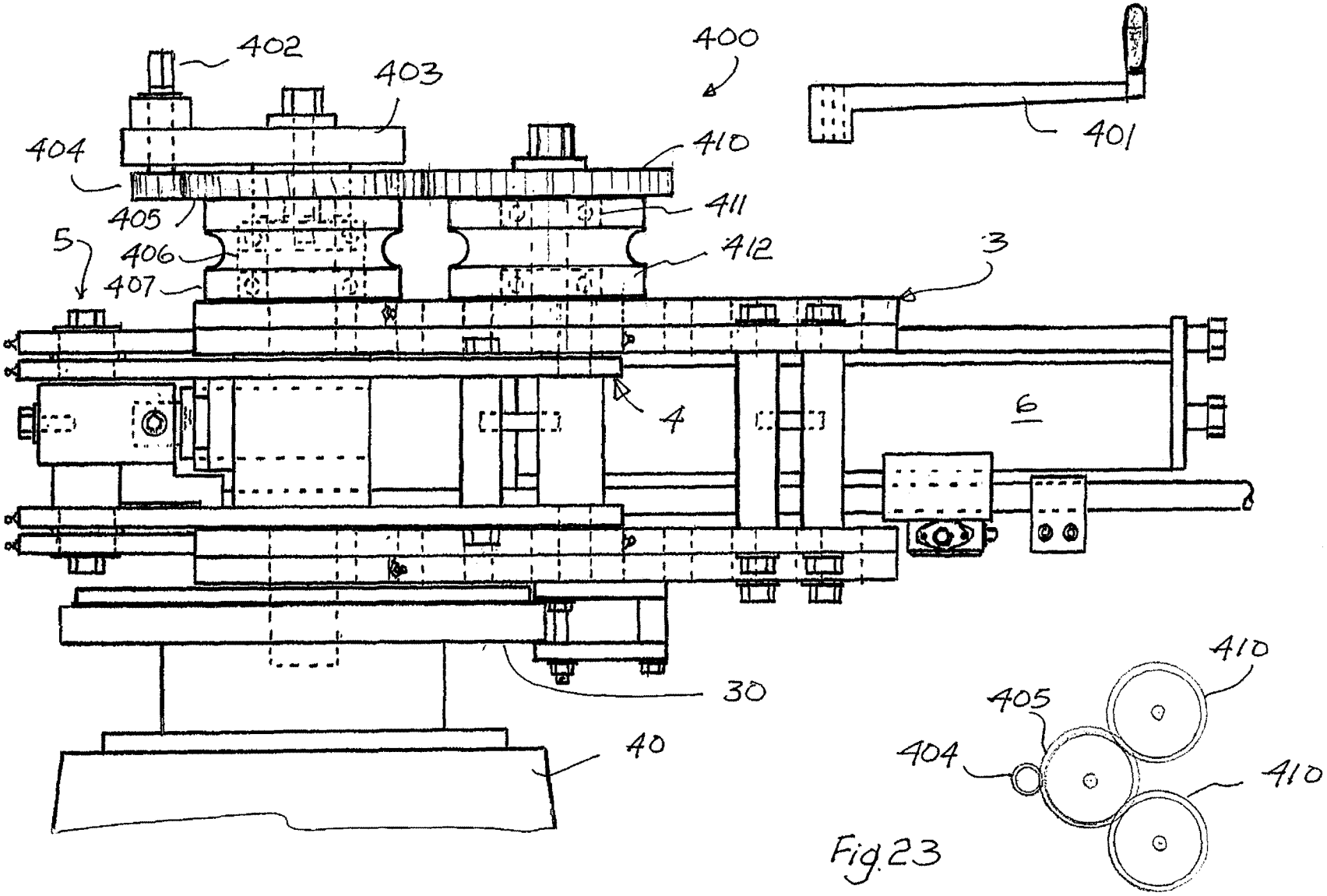
FIG. 23 shows a machine incorporating three dies with interconnected gears.

Referring to FIG. 23 a machine 400 also has many parts like those of the embodiments above and like parts are given the same reference numerals. In this case a handle 401 provides drive via a shaft 402 to a gear 404 through a plate 403. The (small) gear 404 drives a larger gear 405 on a die bearing 406 for a die 407. Each working arm 3 supports a die assembly with a gear 410 intermeshed with the gear 405, as also shown in plan in FIG. 23. Each gear 410 is on a bearing 411 for a die 412.

The machine 400 has the advantage that the dies may apply a particularly small radius bend and do so without slippage of the dies. Slippage has in the past been a particular problem for roller bending with a small radius of curvature.

It will be appreciated that the invention in the various embodiments achieves simplicity and cost-effectiveness due to the small number of parts. For example, the die support shaft performs the multiple roles of supporting the main die and of providing a pivot joint for the working arms supporting the counter dies. Moreover, it also guides the ram orientation in a central and symmetrical manner for bending accuracy. There is also excellent versatility because of the range of mutual angles through which the dies may be driven, the choice of counter die locations on the working arms, and the possibility of having die supports on the working arms and also of self-driving the dies.

The invention is not limited to the embodiments described but may be varied in construction and detail. For example, the link arms may be indirectly pivotally connected to each other, such as via a short bar. This, however, creates an additional pivot joint and might restrict freedom of movement of the link arms.

The translational drive component may be provided by any other suitable drive such as a screw.

Where an individual die drive is provided (such as the drive 220), this may be, additionally or alternatively, for the main die rather than just for the counter dies.

There may be built-in electronic and/or optical sensors for the ram, rather than a piston follower arrangement.

The invention claimed is:

1. A bending machine comprising:

a die support shaft having a die support shaft axis, said die support shaft having a through hole extending through said die support shaft axis, a die mounted on the die support shaft, at least two working arms:

each supporting a counter die, and mounted to rotate about the die support shaft to move the counter dies to bend a work-piece in conjunction with said die on the die support shaft, link arms pivotally connected by pivot joints to the working arms, a translational drive:

being coupled to said link arms, mounted to extend through said die support shaft through hole, and having a longitudinal axis along which said translational drive acts to drive the working arms via said link arms to rotate about the die support shaft.

2. The bending machine as claimed in claim 1, wherein the translational drive includes a ram coupled to said link arms.

3. The bending machine as claimed in claim 1, wherein the translational drive is connected to a pivot joint or joints interconnecting said link arms.

4. The bending machine as claimed in claim 1, wherein the working arms include a plurality of counter die support fixtures.

5. The bending machine as claimed in claim 1, further comprising a plurality of counter die support fixtures and said fixtures include holes or sockets.

6. The bending machine as claimed in claim 1, further comprising a counter die support mounted on at least one of said working arms and supporting a die, wherein said support is adapted to allow adjustment of position of a counter die with respect to the working arm.

7. The bending machine as claimed in claim 1, further comprising a counter die support mounted on at least one of said working arms and supporting a die, wherein said support is adapted to allow adjustment of position of a counter die with respect to the working arm, and wherein the adjustment is infinite.

8. The bending machine as claimed in claim 1, further comprising counter die supports mounted on at least one of said working arms and supporting a die, and wherein the supports are arranged to support counter dies asymmetrically.

9. The bending machine as claimed in claim 1, further comprising a die drive mechanism arranged to directly rotate a bearing for said die.

10. The bending machine as claimed in claim 1, further comprising a die drive mechanism adapted to rotate said die, wherein the die drive mechanism is dedicated to said die.

11. The bending machine as claimed in claim 1, further comprising a die drive mechanism adapted to rotate said die, and wherein the die drive mechanism comprises a feature for engaging one of said working arms at a location spaced apart from the bearing, to prevent rotation of the mechanism.

12. The bending machine as claimed in claim 1, further comprising a die drive mechanism adapted to rotate said die, and wherein the die drive mechanism includes a feature engaging one of said working arms at a location spaced apart from the bearing, to prevent rotation of the die drive mechanism; and wherein said feature is spaced apart by a distance corresponding to separation of two engagement features of a working arm.

13. The bending machine as claimed in claim 1, further comprising a die drive mechanism adapted to rotate said die, wherein the machine comprises a plurality of die drive mechanisms, and said mechanisms are adapted to operate in synchronism for roller bending of a work-piece.

14. The bending machine as claimed in claim 1, wherein the machine includes a fixed machine base and the die support shaft is rotatable on said fixed machine base for adjustment of orientation of the machine components mounted on the die support shaft.

15. The bending machine as claimed in claim 1, wherein the machine includes a lock for locking a working arm, causing at least one working arm joint to be static and other working arm joints to be movable in a plane normal to the die support shaft axis.

16. The bending machine as claimed in claim 1, further comprising means for locking the translational drive.

17. The bending machine as claimed in claim 1, wherein at least one working arm pivot joint is hollow and supports a die, and the machine includes a rotational drive extending through said working arm pivot joints to apply rotational drive to a die.

18. The bending machine as claimed in claim 1, wherein a at least one working arm pivot joint is hollow and supports a die, and a rotational drive extends through said pivot joint to apply rotational drive to said die; and wherein said pivot joint is between a link arm and a working arm.

19. The bending machine as claimed in claim 1, wherein the base includes a hydraulic drive arranged to pump oil through conduits in the die support shaft to the translational drive.

20. The bending machine as claimed in claim 1, wherein the machine further comprises a die support comprising a plate with a slot to guide translational movement of a die.

* * * * *